US011536027B2

(12) United States Patent
Hodgson

(10) Patent No.: US 11,536,027 B2
(45) Date of Patent: Dec. 27, 2022

(54) COMPOSITE FOAM AND CONCRETE FOUNDATION, COMPOSITE FOAM AND CONCRETE WALL AND METHOD OF MOUNTING COMPOSITE FOAM AND CEMENT WALL TO THE FOUNDATION

(71) Applicant: James Hodgson, Buchanan, ND (US)

(72) Inventor: James Hodgson, Buchanan, ND (US)

( * ) Notice: Subject to any disclaimer, the term of this patent is extended or adjusted under 35 U.S.C. 154(b) by 0 days.

(21) Appl. No.: 16/935,860

(22) Filed: Jul. 22, 2020

(65) Prior Publication Data

US 2020/0347597 A1 Nov. 5, 2020

Related U.S. Application Data

(63) Continuation of application No. 16/749,403, filed on Jan. 22, 2020, now abandoned, which is a (Continued)

(51) Int. Cl.
*E04C 2/288* (2006.01)
*E04B 2/68* (2006.01)
(Continued)

(52) U.S. Cl.
CPC ..... *E04C 2/288* (2013.01); *E04B 2/24* (2013.01); *E04B 2/38* (2013.01); *E04B 2/52* (2013.01); *E04B 2/64* (2013.01); *E04B 2/68* (2013.01)

(58) Field of Classification Search
CPC ... E04C 2/288; E04C 2/40; E04C 5/12; E04C 2002/002; E04B 2/64; E04B 2/68;
(Continued)

(56) References Cited

U.S. PATENT DOCUMENTS 2,753,962 A * 7/1956 McBerty ..... E04B 2/68 52/762
3,382,637 A 5/1968 Longinotti
(Continued)

OTHER PUBLICATIONS

Prosecution History from U.S. Appl. No. 14/854,966, filed Sep. 15, 2015 including: Notice of Allowance dated Oct. 23, 2019; Non-Final Rejection dated Jul. 1, 2019; Advisory Action dated Apr. 11, 2019; Final Rejection dated Jan. 24, 2019; Non-Final Rejection dated Sep. 11, 2018; Advisory Action dated Jul. 27, 2018; Final Rejection dated Apr. 17, 2018; Non-Final Rejection dated Oct. 10, 2017; Advisory Action dated Aug. 24, 2017; Final Rejection dated Jun. 15, 2017; Non-Final Rejection dated Feb. 24, 2017; Advisory Action dated Jan. 26, 2017; Final Rejection dated Oct. 12, 2016; Non-Final Rejection dated Jun. 2, 2016; Requirement for Restriction dated Mar. 14, 2016.
(Continued)

*Primary Examiner* — Andrew J Triggs
(74) *Attorney, Agent, or Firm* — Peter J. Ims; Westman, Champlin & Koehler, P.A.

(57) ABSTRACT

A composite foam and concrete wall includes a foam layer having a top surface, a bottom surface, a left wall surface and a right wall surface wherein the foam layer comprises at least two foam panels that define a seam that is substantially parallel to the top surface and the bottom surface. A concrete layer is secured to a surface of the foam layer.

15 Claims, 39 Drawing Sheets

Related U.S. Application Data continuation of application No. 14/854,966, filed on Sep. 15, 2015, now Pat. No. 10,577,798.

(60) Provisional application No. 62/050,471, filed on Sep. 15, 2014.

(51) Int. Cl.

| | |
|---|---|
| ***E04B 2/38*** | (2006.01) |
| ***E04B 2/64*** | (2006.01) |
| ***E04B 2/24*** | (2006.01) |
| ***E04B 2/52*** | (2006.01) |

(58) Field of Classification Search

CPC ..... E04B 2/24; E04B 2/38; E04B 2/52; E04B 1/415; E04B 1/4157; E04B 1/355

See application file for complete search history.

(56) References Cited

U.S. PATENT DOCUMENTS 4,517,782 A 5/1985 Shamszadeh
4,706,429 A 11/1987 Young
4,731,971 A 3/1988 Terkl
4,841,702 A 6/1989 Huettemann
4,856,244 A 8/1989 Clapp
4,942,707 A 7/1990 Huettemann
5,172,532 A 12/1992 Gibbar, Jr.
5,381,635 A 1/1995 Sanger
6,260,329 B1 * 7/2001 Mills ..... E04C 2/049 52/309.4
6,272,749 B1 8/2001 Boeshart et al.
6,305,135 B1 10/2001 Inaba
6,408,594 B1 6/2002 Porter
6,550,215 B1 4/2003 Pulte et al.
6,557,256 B2 5/2003 Billings
6,817,150 B1 11/2004 Boeshart
7,100,336 B2 9/2006 Messenger et al.
7,666,258 B2 * 2/2010 Guevara ..... E04C 2/044 106/724
7,790,302 B2 * 9/2010 Ladely (Guevara) .... E04B 5/19 428/703
7,810,293 B2 * 10/2010 Gibbar ..... E04C 2/288 52/309.7
8,312,683 B2 * 11/2012 Tadros ..... E04C 2/044 52/309.11
8,555,584 B2 10/2013 Ciuperca
8,632,332 B2 * 1/2014 Spude ..... E04G 11/14 425/425
8,734,691 B1 5/2014 Boeshart
8,844,227 B1 * 9/2014 Ciuperca ..... E04C 2/205 52/309.11
9,453,647 B2 * 9/2016 Kriens ..... F24D 3/14
10,577,798 B1 * 3/2020 Hodgson ..... E04B 1/14
2002/0148187 A1 10/2002 Walters
2005/0086904 A1 * 4/2005 Foley ..... E04C 2/288 52/782.1
2008/0041004 A1 2/2008 Gibbar et al.
2008/0250739 A1 * 10/2008 Krupinski ..... B65D 19/0028 52/309.4
2009/0151281 A1 6/2009 MacDonald et al.
2009/0202307 A1 * 8/2009 Au ..... E02D 27/02 405/233
2009/0205285 A1 * 8/2009 Jendusa ..... E04B 5/29 52/650.3
2010/0018141 A1 1/2010 Kelly
2010/0139183 A1 * 6/2010 Eigl ..... E02D 29/025 52/127.1
2011/0072753 A1 3/2011 MacDonald
2015/0059267 A1 * 3/2015 Zhong ..... E04G 9/05 52/204.1
2020/0157814 A1 * 5/2020 Hodgson ..... E04B 2/64
2020/0347597 A1 * 11/2020 Hodgson ..... E04B 2/64

OTHER PUBLICATIONS

Prosecution History from U.S. Appl. No. 16/749,403, filed Jan. 22, 2020 including: Restriction Requirement dated Jun. 2, 2020.

* cited by examiner

COMPOSITE FOAM AND CONCRETE FOUNDATION, COMPOSITE FOAM AND CONCRETE WALL AND METHOD OF MOUNTING COMPOSITE FOAM AND CEMENT WALL TO THE FOUNDATION

CROSS REFERENCE TO RELATED APPLICATION(S)

The present application is a continuation of U.S. Utility patent application Ser. No. 16/749,403 entitled COMPOSITE FOAM AND CONCRETE WALL AND METHOD CONSTRUCTING THE SAME filed on Jan. 22, 2020 which was a continuation of U.S. Utility patent application Ser. No. 14/854,966 entitled COMPOSITE FOAM AND CONCRETE FOUNDATION COMPOSITE FOAM AND CONCRETE WALL AND METHOD OF MOUNTING COMPOSITE FOAM AND CEMENT WALL TO THE FOUNDATION that was filed on Sep. 15, 2015 which claims benefit to U.S. Provisional Patent Application Ser. No. 62/050,471 entitled COMPOSITE FOAM AND CEMENT WALL AND METHOD OF MAKING SAME that was filed on Sep. 15, 2014, the contents of which are incorporated by reference in its entirety.

BACKGROUND

The present disclosure relates to a composite foam and concrete foundation and a composite foam and concrete wall and a method of mounting the wall to the foundation.

Construction of a typical footing is very labor intensive and can take a considerable amount of time to construct. The typical structure requires a hole to be excavated to a desired depth such that a footing can be constructed that will not be affected by frost or other conditions created by the climate. However, in some construction projects excavation of the soil is not required. The footing is then typically placed concrete. Once cured, a foundation wall, typically cinder blocks secured with mortar, a cementious wall or a masonary wall is then constructed with the footings providing the necessary support for the structure. Once the foundation wall is cured, soil is backfilled around the foundation wall to provide a desired grade away from the foundation.

However, excavation of the soil, placing the footing, waiting for the footing to cure, constructing the foundation wall and waiting a sufficient time for curing takes a significant amount of time and effort that increases the cost of construction. It may be beneficial and cost effective to utilize a foam foundation that can be utilized to support a foundation wall, which may or may not be preformed.

A typical wall includes a bottom plate or foundation sill that is attached to a foundation, typically a concrete slab or concrete wall. Bottom ends of spaced apart vertical studs are secured to the bottom plate and a top ends of the spaced apart vertical studs are secured to a top plate. A height of the wall is essentially defined by the length of the vertical studs. The wall provides the support for the outer wall material, such as wood panels and siding, and also the interior wall material, such as sheet rock. Insulation is typically placed between the studs when the stud wall is raised into place and the outer wall material is secured to the stud wall.

Construction of the stud wall is very labor intensive and can take a considerable amount of time to construct. The studs must be cut to a precise length and secured to the bottom and top plates, typically with nails. In the event windows and/or doors are to be placed into the wall, then the studs must be cut to accommodate the required space for the window and/or door and the space must be reinforced with a lintel, which also must be constructed by the construction workers.

Once the stud wall is formed, it is raised and secured to the foundation, typically with bolts that are set into the concrete foundation and through bores in the bottom plate. The bores in the bottom plate are positioned about the bolts. Washers are positioned on the bolts and nuts threadably engage each bolt to frictionally secure the bottom plate to the foundation. Once the stud wall is raised, the outer wall is secured to the studs typically with nails and then siding is secured to the outer wall.

Electric wiring and plumbing are then installed which may including drilling through the studs to place the wiring and plumbing in the desired locations within the wall. Installation of the electric wiring and plumbing can be very labor intensive, time consuming and costly.

In many developing locations, such as the oil fields of North Dakota, the lack of adequate housing is an issue. While people are willing to pay for the construction of a residence, the labor force is not available to meet the housing construction needs. The use of a standard wood stud frame for the residence is one of the impediments to having the required housing built due to the time required to properly build a structure with stud walls.

Also, while quality lumber is currently available, it is foreseeable that in the future that the wood required for the stud wall may not be available. As such, there is a need for a wall, that does not require wood, or other renewable materials, which can be quickly constructed while having good energy and sound efficiency.

SUMMARY

One aspect of the present disclosure relates to a composite foam and concrete wall. The composite foam and concrete wall is formed by aligning slabs of foam side by side to form a foam layer where the seams between the foam panels are substantially parallel to the upper and lower edges of the composite wall. Spaced apart channels are formed into an upper surface of the aligned slabs of foam substantially perpendicular to the seams wherein the pilasters are a sufficient depth to aid in securing a concrete layer to the upper surface of the foam panels. A horizontal channel is formed into the foam layer at a top surface. Rebar is placed in the channels and is raised from the foam surface a selected distance with rebar chairs. An end plate utilized as a top wall of a form with spaced apart lifting mechanism is positioned proximate the top end of the foam layer and proximate a top edge of the horizontal channel. A remaining portion of the form is placed about a perimeter of the foam layer and extends upwardly above the foam layer a selected distance, where the distance defines a wythe of concrete of the composite wall. Concrete is then placed into the form and over the foam layer wherein the concrete is placed into the channels and creates pilasters that increase the structural strength of the wall and also increase the bond strength between the concrete layer and the foam layer. When the wall is raised, utilizing the lifting mechanisms within an upper horizontal pilaster proximate the top portion of the form, the lifting force is substantially perpendicular to the seams in the foam and, therefore, prevents cracking in the concrete during the lift. While the concrete is not set, structural detail can be added to the surface, such as rocks, coloring or a stamping that resembles siding or a brick pattern. Because of the thickness of the concrete, the wall is structural, meaning it satisfies the requirements of a load bearing wall and the foam layer provides superior thermal and sound insulating qualities.

Another aspect of the present disclosure relates to a composite foam and concrete foundation. The foundation includes a foam portion that can define the dimensions of the foundation, including the length, the width and the height of the foundation. An upper channel is formed into the foam portion substantially along a longitudinal axis extending along the length of the block from a top surface and into the block. The upper channel extends about one half the thickness of the block and can have a dovetailed construction such that a width of the bottom of the channel is greater than the opening in the top surface and wherein both left and right side surfaces extend inwardly at an acute angle from the bottom surface of the channel to the opening. The opposing ends of the foam block include left and right openings that extend from the top surface to the bottom surface where a top portion of the left and right openings is defined by the upper channel. Lower portions of the left and right openings can have a dovetail configuration where an opening at the bottom surface is lower than that of the transition from the upper surface to the lower surface. Rebar may optionally placed within the upper channel and/or the left and right opening and concrete is then placed into the upper channel and the left and right openings such that the concrete is substantially even with the outer surfaces of the foam portion. Because of the thickness of the concrete in the upper channel, the composite foam and concrete foundation meets the structural requirements of a standard foundation while being able to be produced off-site or prior to the construction of the structure. In some structures, piers or pilings may also be used to ensure the structural requirements are met.

Another aspect of the present disclosure relates to a method of constructing a foundation of structure. The method includes positioning a number of pilings or piers into the soil at locations where foundations described above abut each other such that the concrete bottom surfaces of the foundation rest on the upper surface of the pier. The piers and foundations are positioned into the soil at a selected depth (which is dependent upon building codes) such that the concrete in the upper surface defines a perimeter of the structure. A structural wall as described above is positioned proximate the foundation and is raised to be positioned on the concrete surface of the foundations where the structural wall is disclosed herein and can be a composite foam and concrete wall. Upper edges of the walls are leveled with shims between the foundation and the wall. Once positioned on the concrete surface of the foundation and leveled, the structural wall is then secured to the foundation by a securing mechanism. Once the walls are secured to the foundations, the adjacent walls are secured together at the seams with adhesive and additional securing mechanisms can secure the adjacent walls together at the top surface. The method also includes positioning an insulating panel about a perimeter of the foundations and adjacent the outside edge of the foundation. The insulating panel extends a selected distance away from the foundation such that the foundation is protected from climatic factors such as frost. Soil is then back filled over the insulating panel, the foundation and is adjacent a lower portion of the structural wall.

Another aspect of the present disclosure includes a bracket that is configured to be secured to a foam layer at least along a side edge and a top edge of the foam layer. The bracket includes a bottom portion configured to be positioned on an upper surface of the foam block and an angled tang forming an acute angle with the bottom portion. The angled tang is configured to be positioned in an angled slot within the foam layer to prevent the bracket from moving on the foam layer as the concrete is placed. A wall extends from a distal edge the bottom portion wherein a distance from a top edge of the wall to the bottom portion defines a thickness of a wythe of concrete, when placed. A screed portion extends from an upper end of the wall where the screed wall is substantially parallel to the bottom portion. The screed wall provides a surface for leveling the placed concrete. The bracket can optionally include angled spaced apart braces extending from the bottom portion to the wall wherein the braces can prevent the wall from flexing outwardly due to forces imparted onto the wall by the placed concrete. In some instances, the bracket supports one or more lifting mechanism that are encased within the placed concrete where the lifting mechanisms can be utilized to lift the wall into place. An angle of the wall can be any desired angle relative to the bottom portion.

DETAILED DESCRIPTION

Figure 1:
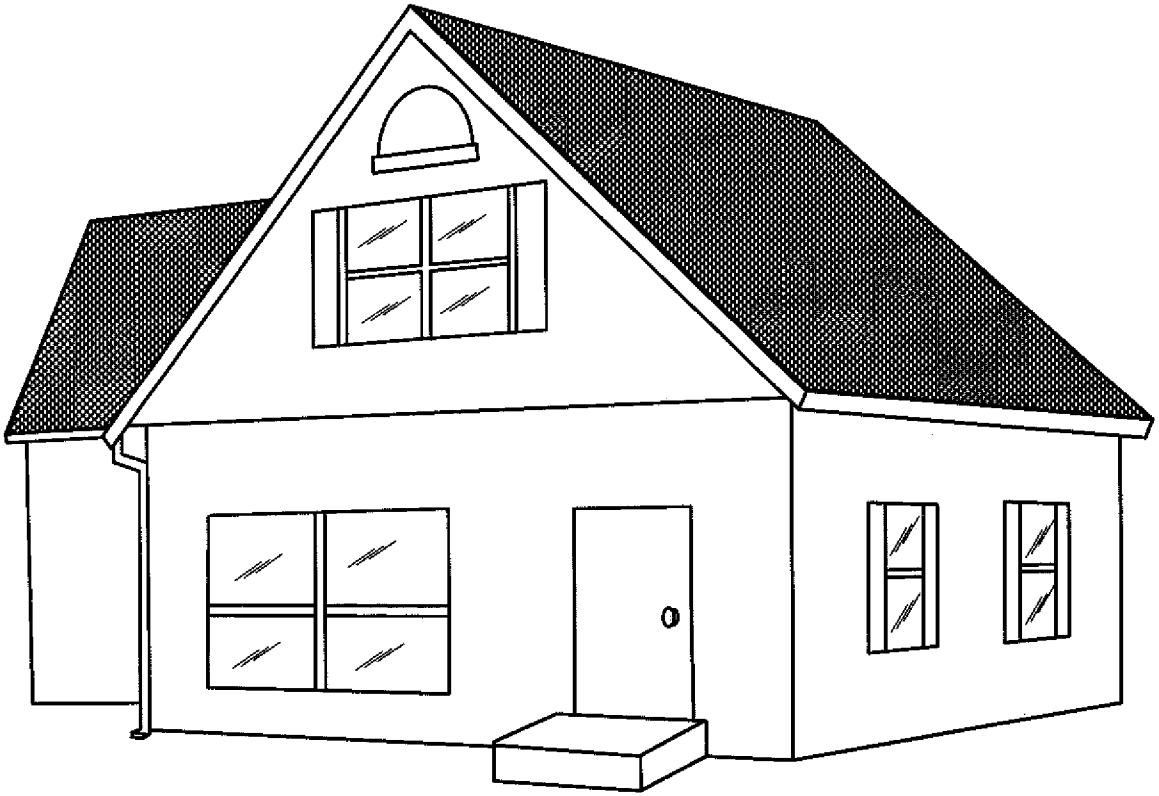
FIG. 1 is a view of a typical gable roofed house.
Figure 2:
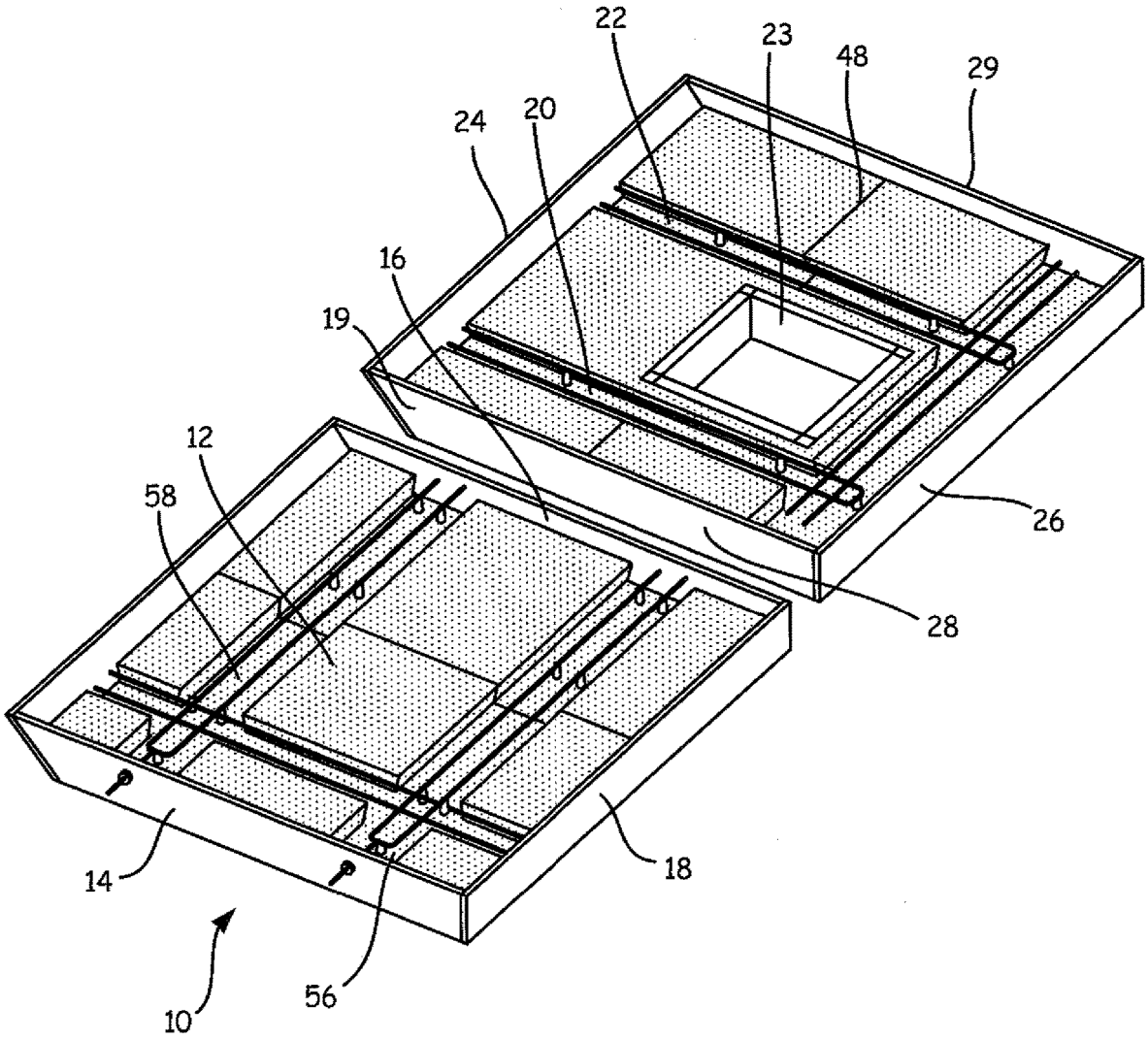
FIG. 2 is a perspective view of a foam layer and form for a solid wall and a wall with a window utilized to form a portion of the house.
Figure 3:
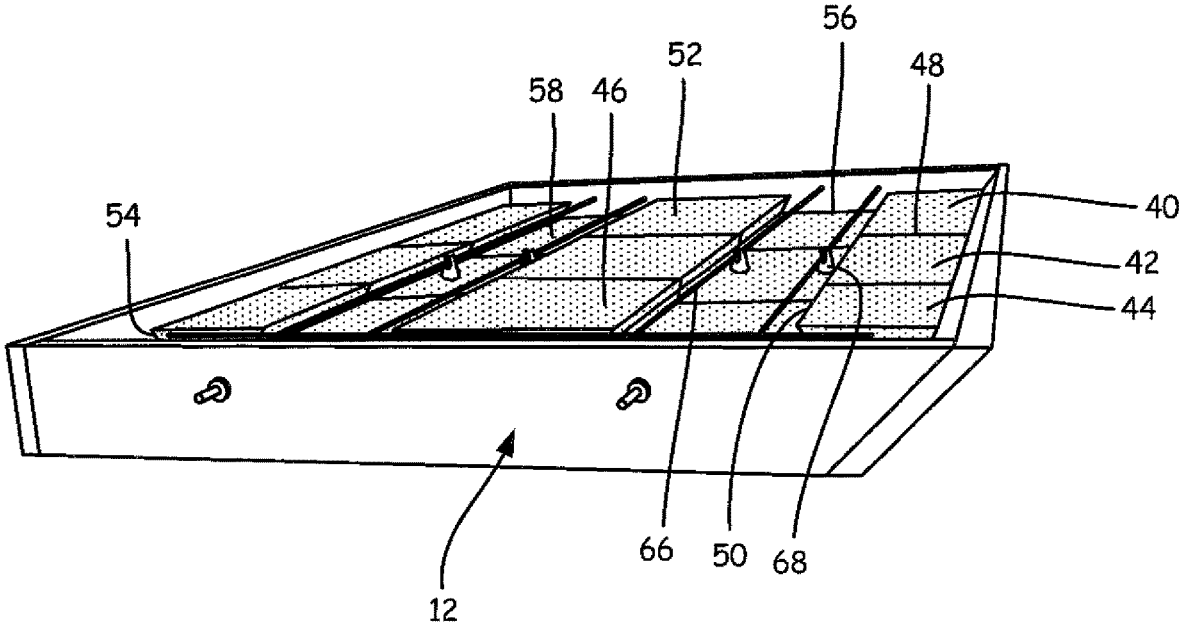
FIG. 3 is an end view of the wall.
Figure 4:
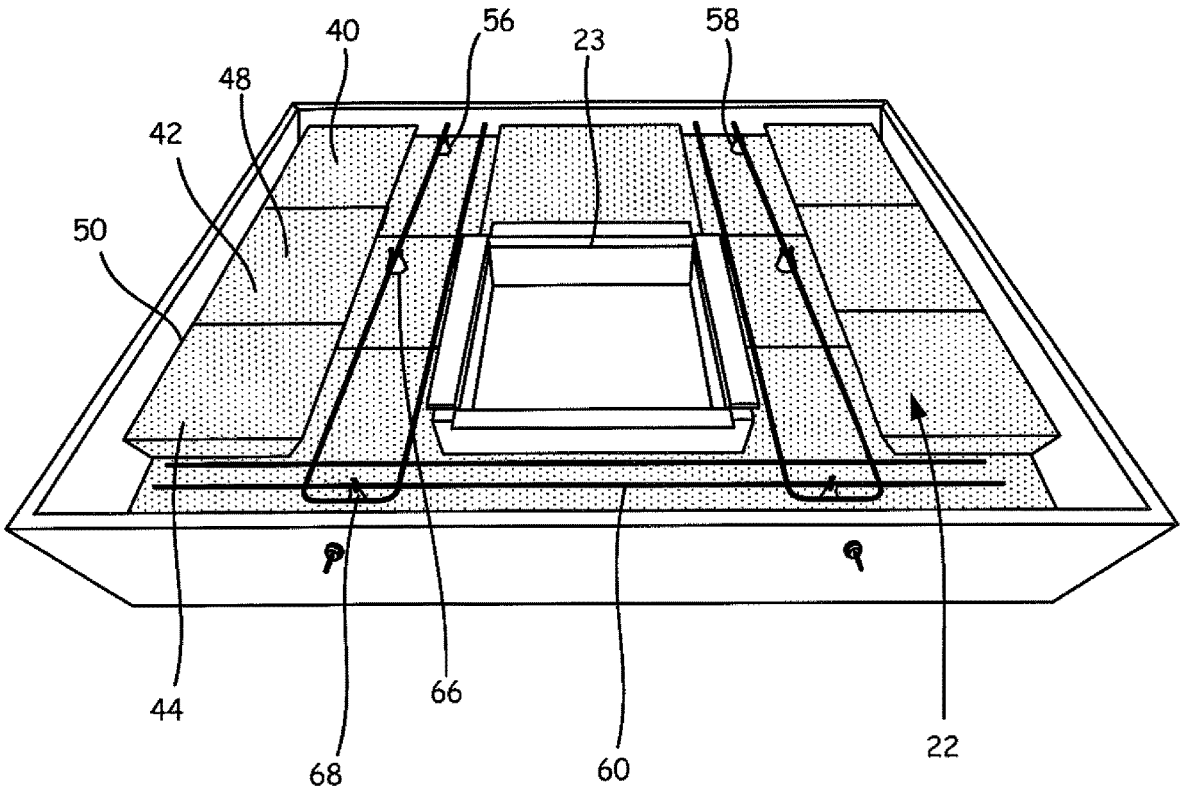
FIG. 4 is a view of a portion of the wall with a portion of the window frame with rebar placed within a pilaster.
Figure 5:
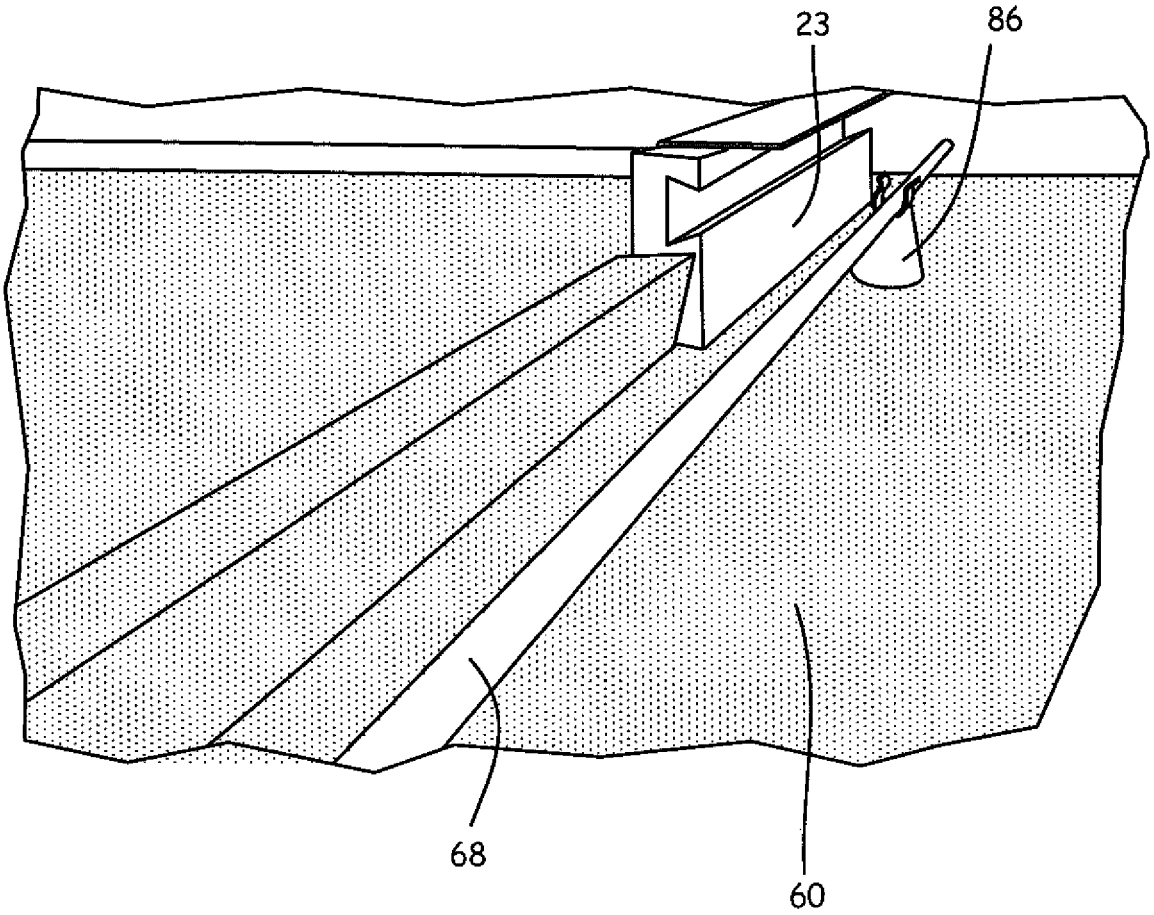
FIG. 5 is another view of a portion of the wall with a portion of the window frame with rebar placed within a pilaster.
Figure 6:
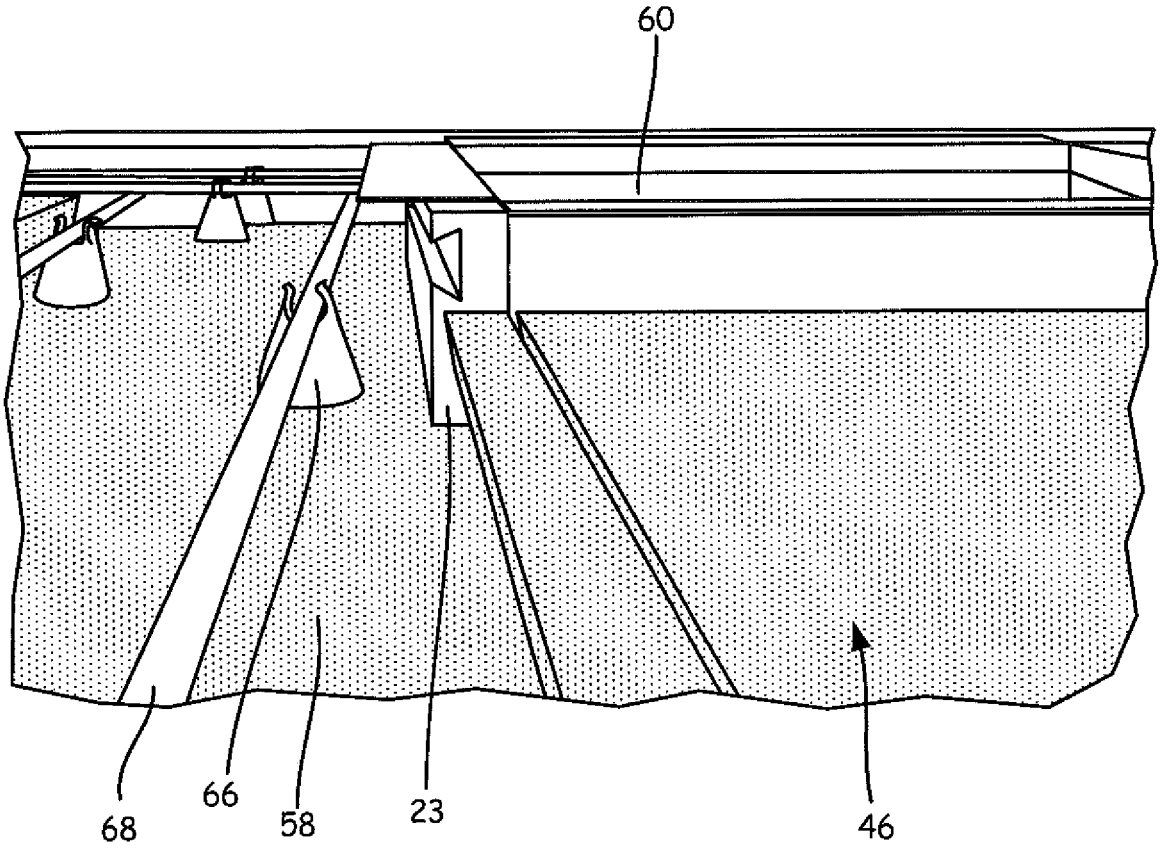
FIG. 6 is a view of a portion of the wall with the top, horizontal pilaster and the top plate.
Figure 7:
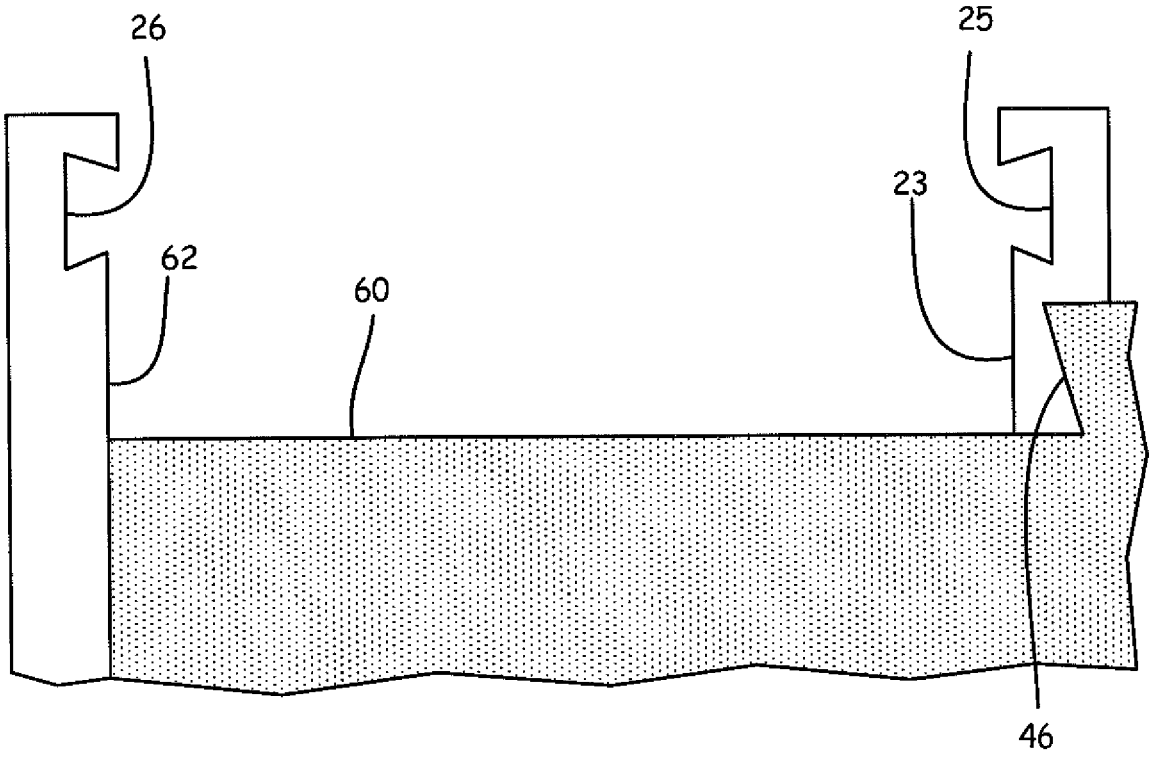
FIG. 7 is another view of the portion of the wall with the top, horizontal pilaster and the top plate.

A gabled house is illustrated in FIG. 1 that is constructed using foundations, walls and methods of construction as disclosed herein. A form 10 for a wall 12 without any openings and a form 20 for a wall 22 with a window frame 23 are illustrated in FIG. 2. The form 10 includes a bottom wall 14 and an opposing top wall 16 that are connected with a right sidewall 18 and a left sidewall 19 wherein the left side wall is at an angle which is about 45 degrees. The form 20 includes a bottom plate 24 and an opposing top plate 26 that are connected with left and right walls 28 and 29. The form 20 does not include an angled wall, but one or both sidewalls 28 and 29 could be at any desired angle.

Referring to FIGS. 2-7, the wall 12 and the wall 22 have a similar foam layer 46 where the layer 46 includes a plurality of foam panels 40, 42 and 44 that are placed adjacent each other such that seams 48 and 50 are substantially parallel to a bottom surface 52 and a top surface 54. The plurality of foam panels 40, 42 and 44 form the foam layer 46 of a composite load bearing wall 12 and 22. While three foam panels 40, 42, and 44 are illustrated to form the height of the wall, any number of panels and any width panels are within the scope of the present disclosure.

A typical foam panel is constructed of modified expanded polystyrene because the foam has a high R value for insulation purposes. The foam layer is typically treated with a pesticide such as zinc borate to prevent insect and rodent infestations. The modified expanded polystyrene foam also is a fire preventative material, as the modified foam material will not promote a fire once the source of the fire is extinguished or removed from the foam. One non-limiting foam material is sold under the INSULFOAM® trademark by the Insulfoam division of the Carlisle Construction Materials headquartered in Puyallup, Wash. However, other materials of the foam panels are also contemplated.

As illustrated the foam panels 40, 42 and 44 are nominally about six inches in thickness. However, a nominal eight inch thickness foam panel is also contemplated. The foam panels can be any desired thickness provided the panels provide the necessary insulation and structure to secure a concrete layer thereto.

The foam layer 46 includes left and right channels 56 and 58 that are cut into the panels 40, 42 and 44 from the bottom surface 52 to the top surface 54 wherein the left and right channels 56 and 58 are substantially perpendicular to the seams 48 and 50. A depth of the pilasters 56 and 58 is nominally about two inches. However, the depth of the channels 56 and 58 can be any depth that aids in securing a concrete layer to the foam layer 46 while not adversely affecting the structural integrity of the foam layer 46. It is understood that the thickness of the foam layer 46 can dictate the depth of the channels 56 and 58.

It is also contemplated that a channel be formed around the entire perimeter of the formed wall which will sheer the entire panel to maintain the panel's shape and integrity. Also, a bottom header or beam is also contemplated, while not illustrated in the figures.

The foam layer 46 includes a channel 60 at the top surface 54 that extends into the foam layer 46 at a similar depth as that of the channels 56 and 58. The channel 60 is substantially the same depth as that of the channels 56 and 58.

The channels 56, 58 and 60 can be formed by any desired mechanism including a chain saw with a depth gauge or a hot melt type of cutting process. Whatever method is utilized, the channels 56, 58 and 60 typically are formed with a dovetail construction where a width of the pilaster 56, 58 and 60 is greater at the bottom surface relative to a top surface.

The top plate 26 includes a dove tail cut 62 along the length to provide additional securing of the concrete layer to the top wall 26. The window frame 23 includes a dado cut 25 about the outer perimeter to also allow concrete to flow therein and provide a more secure attachment of the concrete layer to the window frame 23. However, dado cuts in the top plate 26 and the window frame 23 are optional.

Once the channels 56, 58 and 60 are formed into the foam panel 46, rebar chairs 66 and rebar 68 are placed into the channels 56, 58 and 60. The rebar 68 provides strength to the concrete within the channels 56, 58 and 60 and prevents the concrete pilasters placed into the channels from cracking within the channels 56, 58 and 60.

Figure 8:
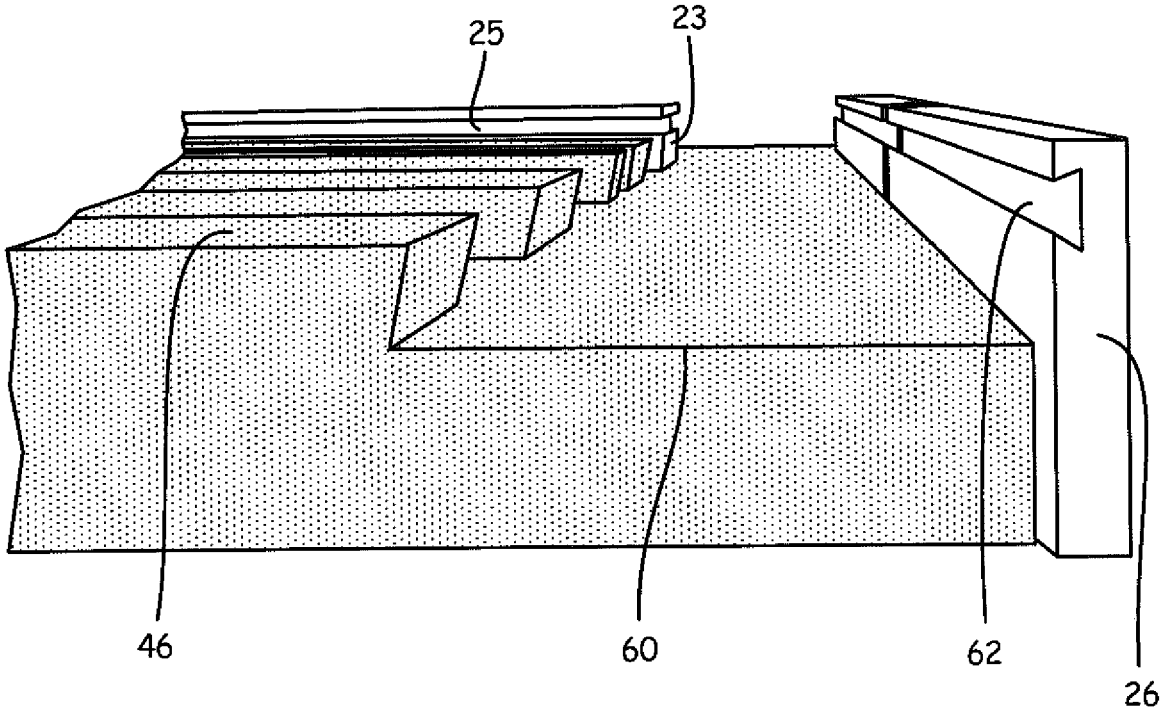
FIG. 8 is a view of a portion of the window frame and the foam wall.
Figure 9:
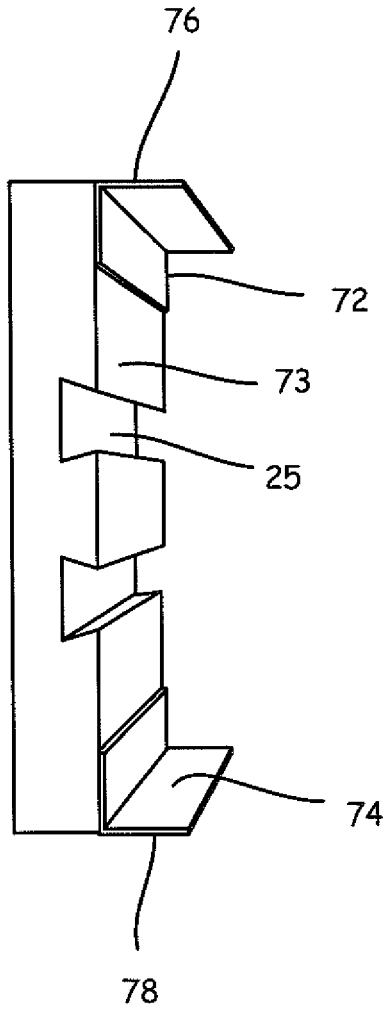
FIG. 9 is a perspective view of the window frame.
Figure 10:
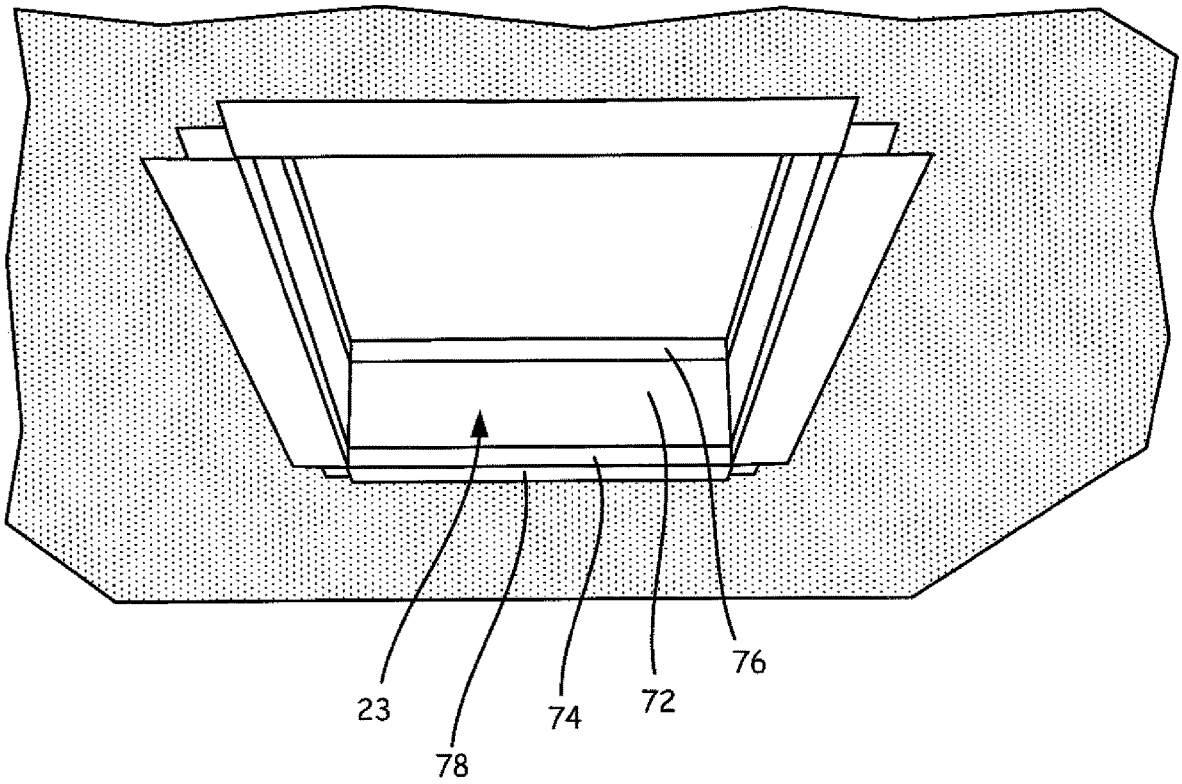
FIG. 10 is a perspective of an installed window frame with the wall.

Referring to FIGS. 8-10, the window frame 23 is installed by utilizing boards 70 that include the dado cuts 25 and have flashing 72 and 74 at the top and bottom edges 76 and 78. A gap between the window frame 23 and the foam panel 46 allows the concrete to be placed between the frame 23 and the foam layer 46. The concrete between the frame 23 and the foam panel 46 forms a tight seal which prevents air infiltration and other external pressures, such as sound, wind, moisture and heat (or cold) from entering into the interior of a build from the exterior and vise versa. The flashing 76 and 78 extends around the perimeter of the window frame 23 about the outer edges 76 and 78 and aids, in preventing water and moisture from entering into the seam between the boards 70 and the foam panel 46 and maintaining a flat interior surface which can be very beneficial when securing dry wall to the interior surface. However, the flashing 76 and 78 is optional.

While any type of board 73 for the window frame 23 can be utilized, a typical pre-manufactured window frame 23 is manufactured by Prebuck LLC located in Grand Rapids, Mich. The boards 73 are engineered laminated strand lumber (LSL) and are treated to prevent decay and insect infestation and have a minimal moisture content of about 4-6 weight percent. The Prebuck engineered boards are made from saplings that are treated and then processed into the engineered board. As such, the treatment extends through the entire board and not just penetrating a portion of the board. Therefore, when the board is cut, the end remains treated and will not decay or be susceptible to insects. The treatment utilized in the Prebuck engineered board is zinc borate, which is a preservative and prevents insect infestation. Zinc borate is not as toxic to human beings as other wood preservatives.

While the use of LSL is disclosed for window and door frames, it is also contemplated that the LSL can also be used for any structural and/or framing members within a building. Suitable LSL structural and/or framing members include those sold under the StrandGuard® trade designation and the TimberStrand® trade designation by Weyerhaeuser Company located in Federal Way, Wash. and the SolidGuard® trade designation by Louisiana Pacific Corporation headquartered in Nashville, Tenn. While an engineered wood window frame treated throughout its thickness with zinc borate is disclosed, any type of material that can be formed into the window frame is within the scope of the present invention. It is also contemplated that a similar manufacturing process be utilized with door frames. It is also contemplated that the windows and door frames be constructed of any suitable building material, including but not limited to metal and composite materials.

A typical window would be a vinyl window wherein the perimeter of the window casing is secured to the window frame 23 with a bead of sealant such as, but not limited to, a caulk. Utilizing a vinyl window frame and caulk removes the need for flashing as there is no means of penetration of water or air between the window casing and window frame 23.

Figure 11:
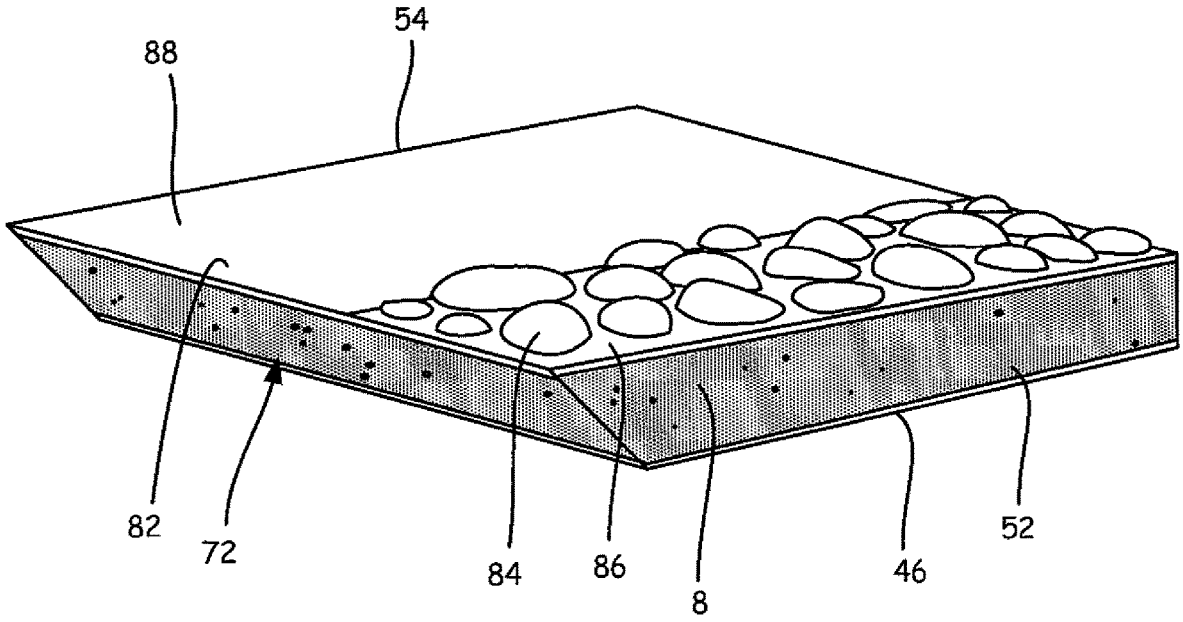
FIG. 11 is a perspective view of the solid wall having a bottom surface treatment and a top surface treatment.
Figure 12:
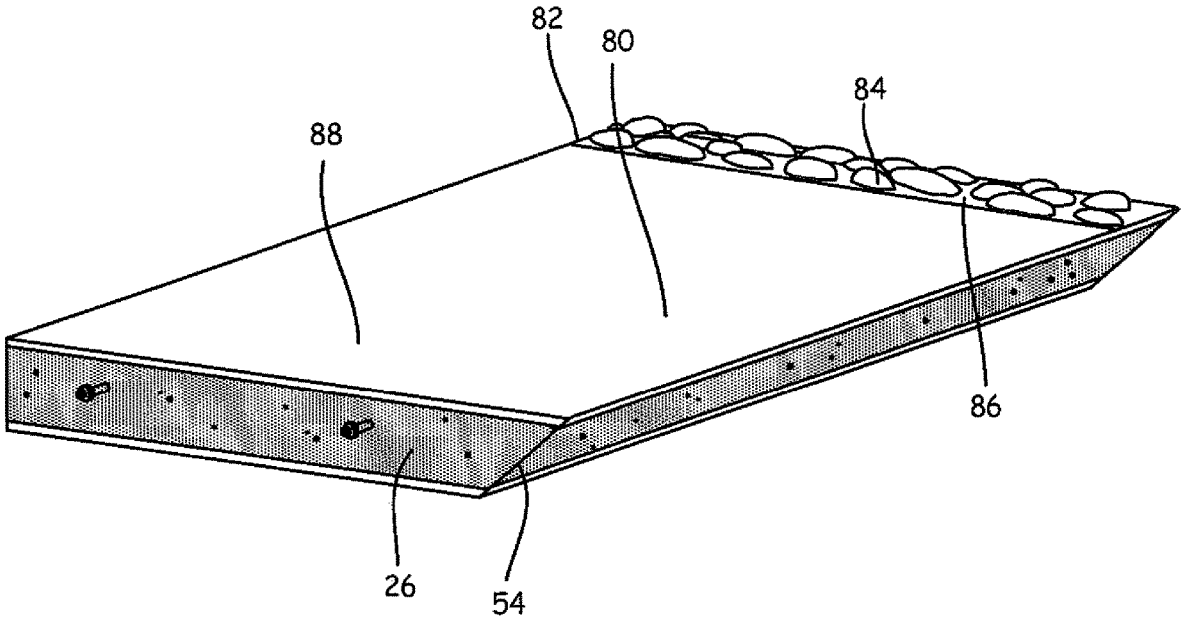
FIG. 12 is another perspective view of the solid wall having a bottom surface treatment and a top surface treatment.

Referring to FIGS. 11 and 12 the finished wall 12 with the foam layer 46 and a concrete layer 80 is illustrated with the framing removed. The concrete layer 80 is at least nominally two inches in thickness which provides sufficient structural integrity such that the wall 12 can be an exterior load bearing wall. The concrete layer 80 fills the channels 56, 58 and 60 to form pilasters in the foam layer and placed until even with a top of the framing. While the concrete layer 80 is not cured, a surface treatment 82 can be applied to the concrete layer 80. As illustrated, field stones 84 are set into the concrete layer 80 in a lower portion 86. The concrete layer 80 in the lower portion 86 is colored a different color than the concrete 80 in an upper portion 88.

While field stones 84 and utilizing different colors in the concrete layer 80 are illustrated, these are but a couple of non-limiting examples of surface treatments that can be utilized. Other non-limiting surface treatments include stamping the concrete to have the appearance of siding or brick. Also, paint, dye or other colorant could be applied or integral to the concrete mix to provide different surface treatment.

Figure 13:
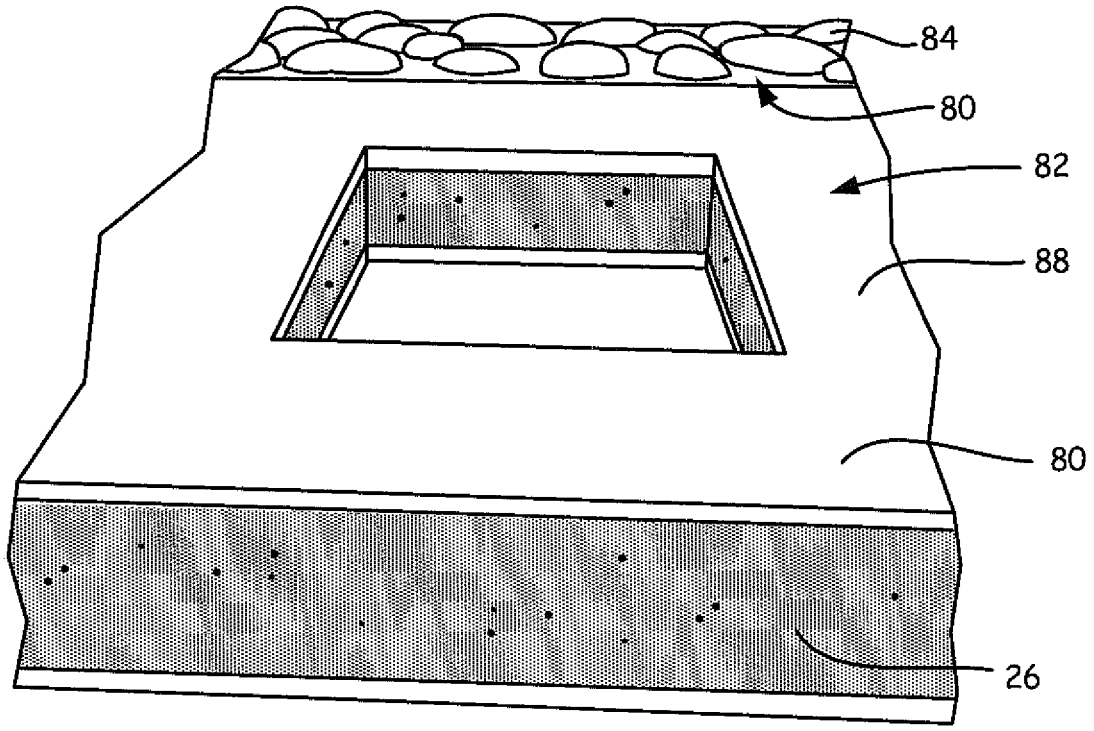
FIG. 13 is a perspective view of the wall with the window having a bottom surface treatment and a top surface treatment.
Figure 14:
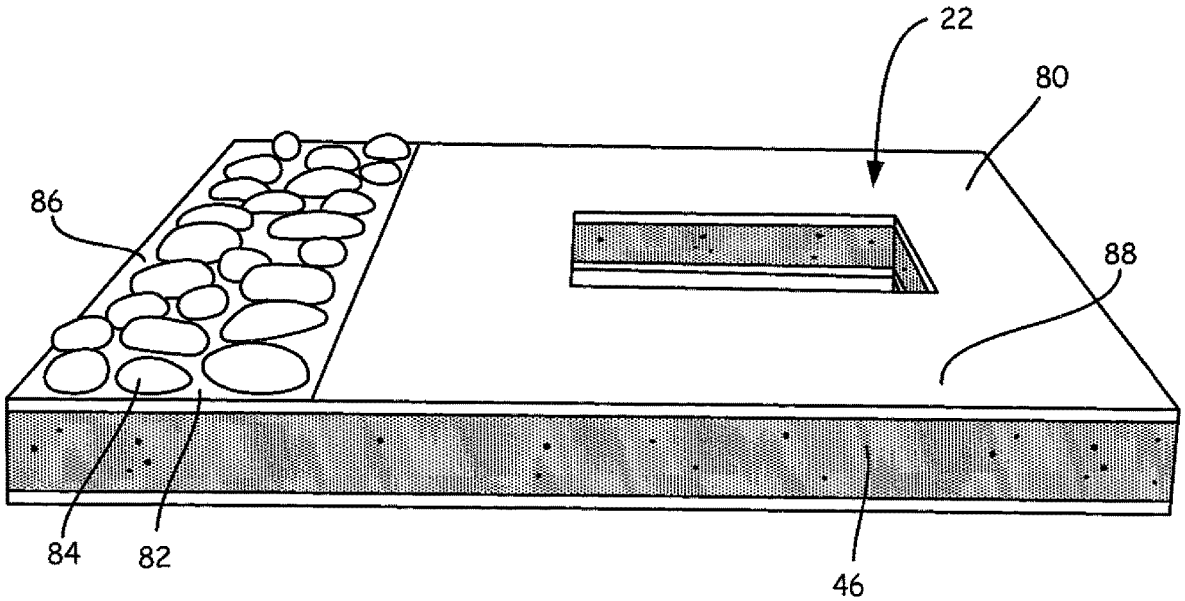
FIG. 14 is another perspective view of the wall with the window having a bottom surface treatment and a top surface treatment.
Figure 15:
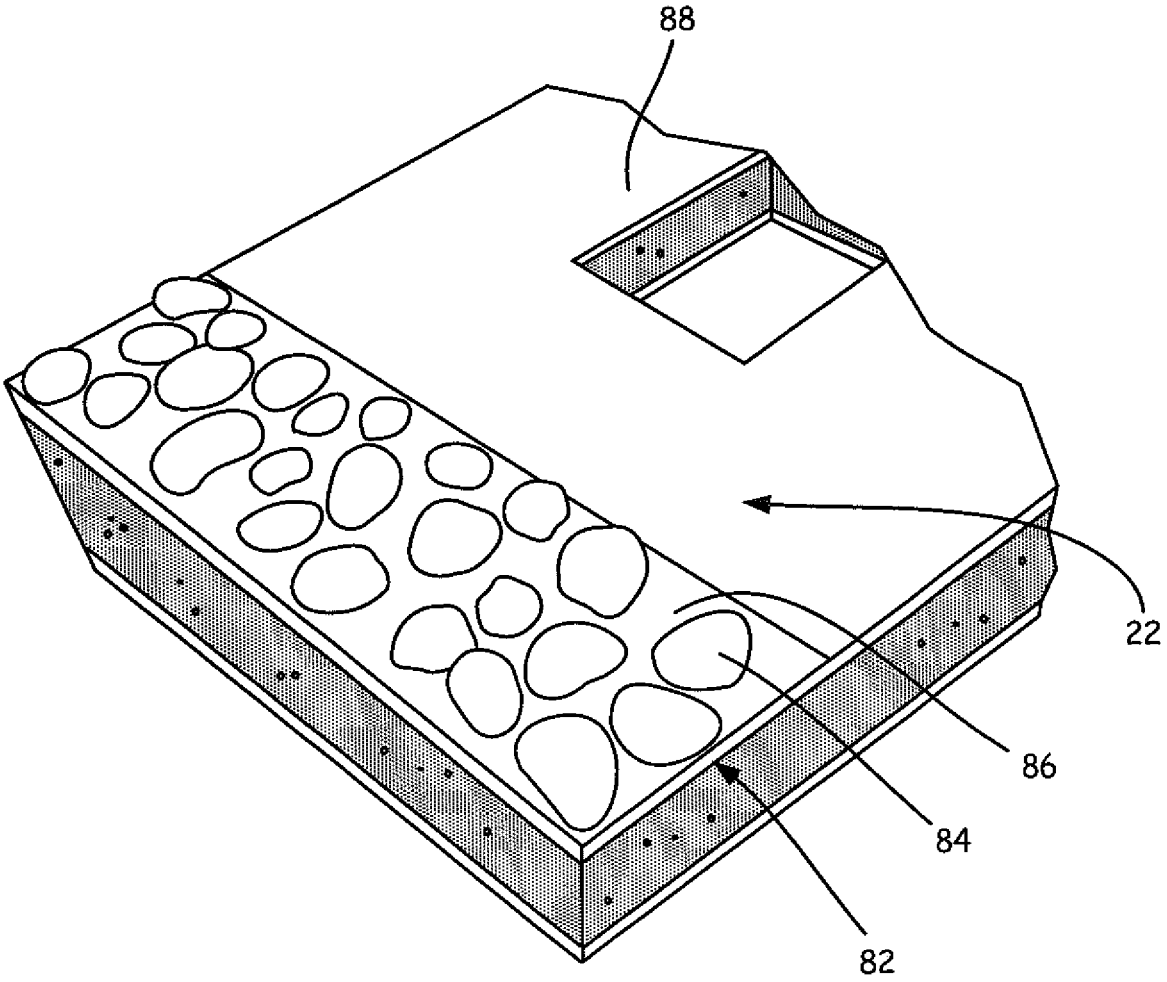
FIG. 15 is another perspective view of the wall with the window having a bottom surface treatment and a top surface treatment.

Referring to FIGS. 13-15 the finished wall 22 is illustrated with the concrete layer 80 secured to the foam layer 46. As illustrated field stone 84 are positioned into the concrete layer at the lower portion 86 as the surface treatment 82. The concrete layer 80 in the lower portion 86 is not colored, and an upper portion 88 has a contrasting color. The window frame 78 has been covered by the concrete layer 80 and is not visible. The concrete layer 80 can have similar treatments as described with respect to the wall 12.

Figure 16:
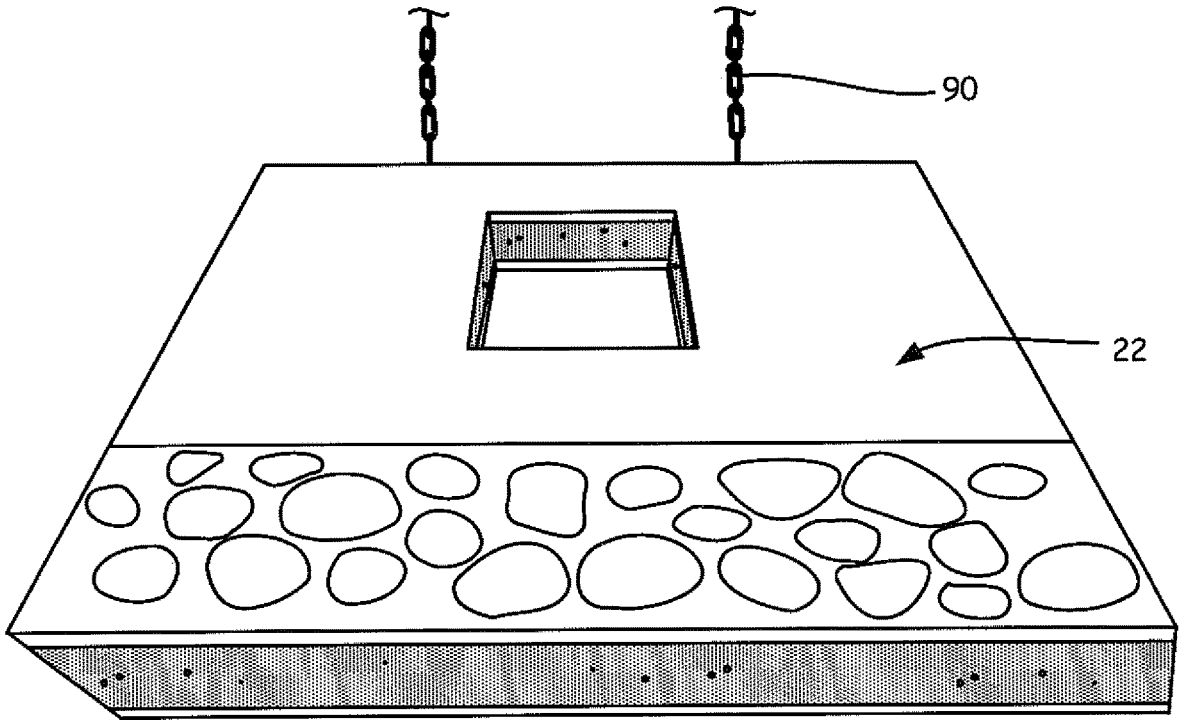
FIG. 16 is a perspective view of the wall with the window having the window being raised with a loader bucket on a tractor.
Figure 17:
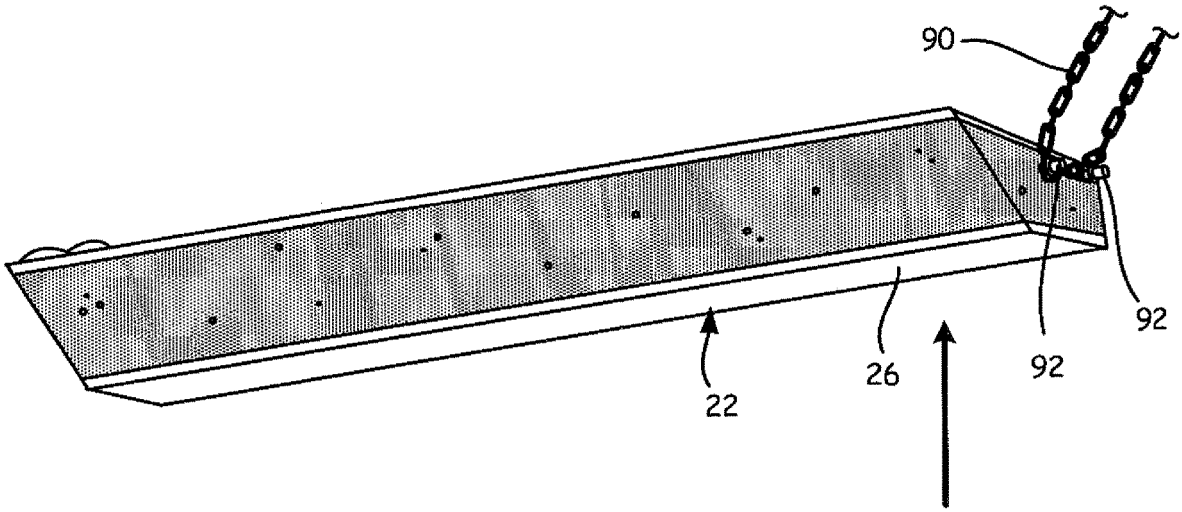
FIG. 17 is a side view of the raised wall.
Figure 18:
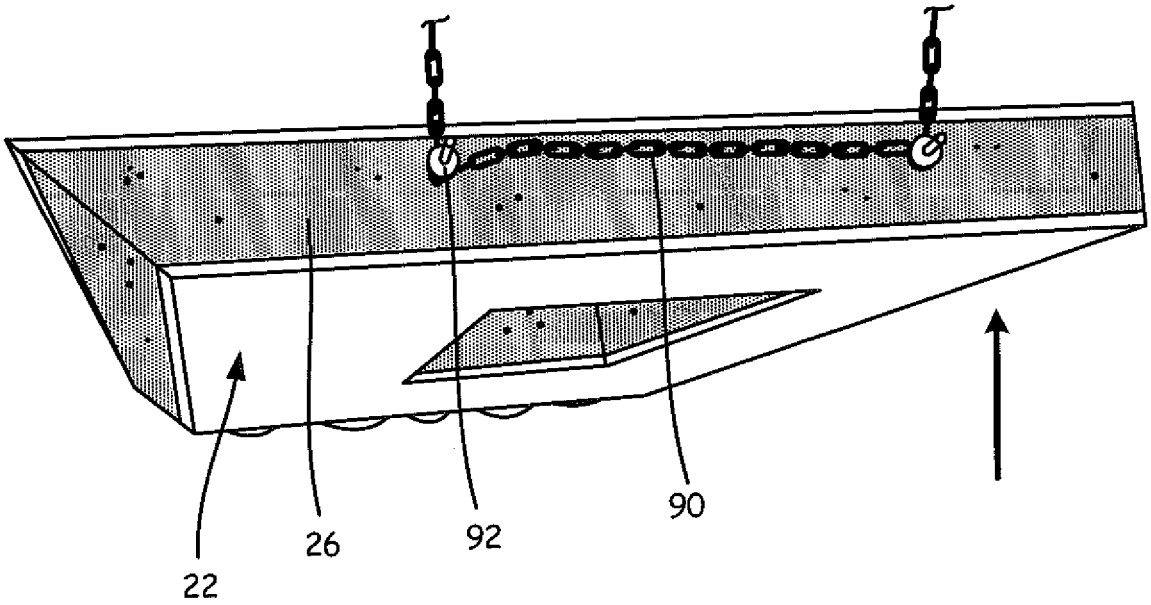
FIG. 18 is a perspective view from the top surface of the raised wall.
Figure 19:
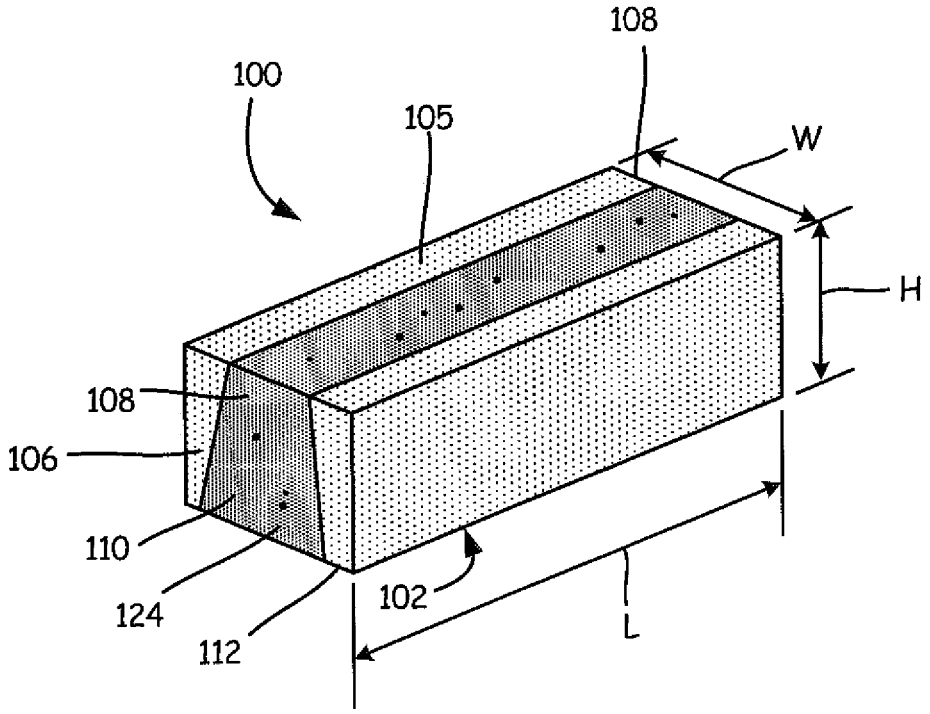
FIG. 19 is a perspective view of a foundation.
Figure 20:
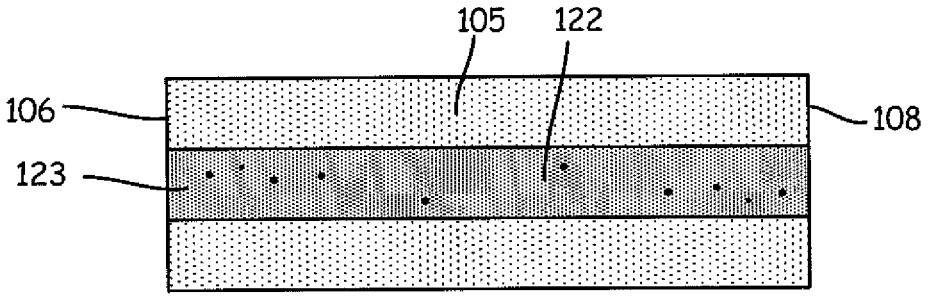
FIG. 20 is a top view of the foundation
Figure 21:
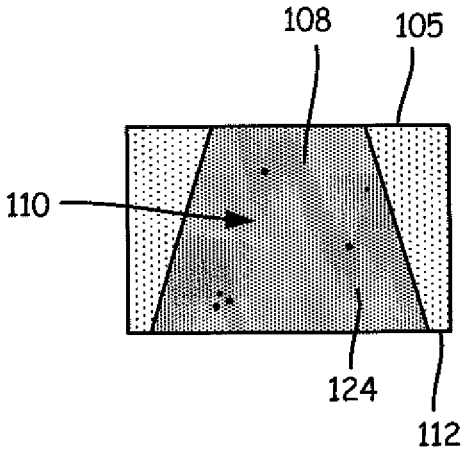
FIG. 21 is an end view of the foundation.
Figure 22:
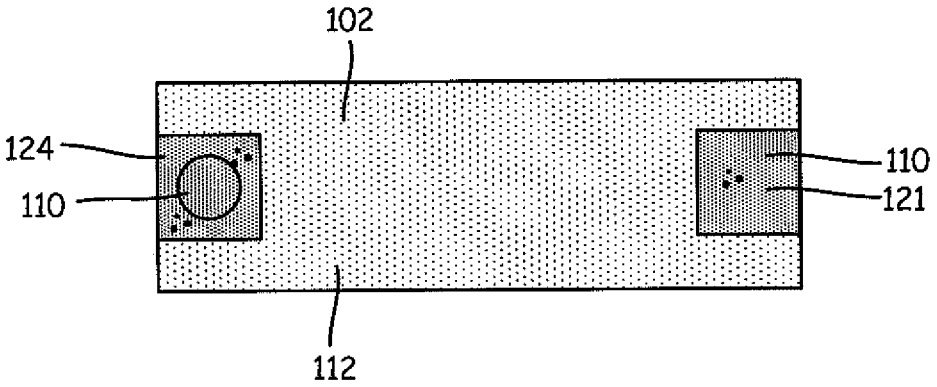
FIG. 22 is a bottom view of the foundation.

Referring to FIGS. 16-18, the wall 22 is illustrated being lifted utilizing a loader bucket on a tractor where chains 90 are secured to bolts 92 in the top plate 26. It should be understood that the pilaster within the channel 60 along the top plate 26 provides additional structural integrity to lift the wall 22 relative to a nominal two inch thickness of the concrete layer 80. As the wall 22 is lifted from a horizontal position to a vertical position, a gravitational force is placed upon the wall 22 that is substantially perpendicular to the seams 48 and 50. As such, the panels 40, 42 and 44 do not move relative to each other as the wall 22 is lifted, which prevents cracking, bowing or bending of the concrete layer 80 which may not be apparent at the time of the lift but will become noticeable over time. It should be understood that the wall 12 is constructed similarly to the wall 22 and will also not cause a crack in the concrete layer 80 when lifted.

It is also contemplated that siding fastening strips, such as furring strip or nailing strip, can be embedded into the concrete layer 80 or have a portion of the siding fastening strips extend from an exterior surface of the concrete layer. The fastening strips can be constructed of wood or metal and are spaced apart to support siding such, for instance, lap siding. As such, Applicant can customize the look of an exterior surface to meet any needs of the owner including having a stone or brick treatment on the bottom portion with lap siding on the upper portion of the wall.

The walls 12 and 22 can be manufactured at a plant or manufacturing facility remote from the site of the construction and therefore can eliminate much of the labor required to build a stud framed structure. The walls 12 and 22 can be prefabricated to any reasonable desired length, width and height and can be lifted and installed on a previously formed foundation at the site. Because of the thickness of the concrete layer 80 the wall 12 can be installed below ground and can be secured to a foundation for the foundation, such that a foundation wall is not required, which can also save time and money compared to a stud frame structure.

Also because the wall 12 and 22 can have beveled side edges such as the side wall 19, two walls can be easily joined together using connectors that are positioned into the adjacent concrete layers 80. Since the connectors would not penetrate though the inner surface of the foam, there would be no thermal bridge from the outside which would affect the insulating properties of the foam layer 46. A typical angle of the beveled edge is 45 degrees so that any wall edge can be mated with any other wall edge. However, other angles of the edges besides 45 degrees are also contemplated. It is also contemplated that the walls 12 and 22 can include interlocking joints which aid in secure the walls 12 and/or 22 together, typically with a securing mechanism.

Because the foam layer 46 is of a thickness such as for example eight inches, the utilities that are required in the wall can be easily installed by cutting channels into the foam layer 46. It is contemplated that a chain saw with a depth guard or a hot knife designed to cut foam can be utilized to quickly and efficiently form the channels. Once the channels are formed into the foam layer the utilities including plumbing and electric wiring can be easily installed.

Also, sheet rock can be glued or adhered to the inner surface of the foam layer 46 so that the building can be quickly finished relative to a structure that utilizes stud walls. When the adhesive is properly applied to the foam or sheet rock, the adhesive forms a vapor barrier that meets code and does not require a plastic wrap. This allows for the elimination of mechanical fastening of the sheet rock by for instance nails or screws, which in turn minimizes the labor required to mount the sheet rock and the finishing of the sheet rock, such as with a mud to evening the seams and cover the nail or screw indentions. Further, no additional insulation in the walls is necessary because the foam layer 46 provides the necessary insulation. As such, the step of installing insulation which is required in a standard stud wall is not required.

It is also contemplated that a layer of plaster can be applied to the foam to provide a finished look to the interior walls instead of the sheet rock. The application of plaster is less expensive and less labor intensive than securing sheet rock to the foam layer and then mudding the seams prior to painting the sheet rock. It is also noted that a colorant can be mixed into the plaster such that a coat of paint may not be required.

As such, the walls of the structure can be formed off-site and shipped to the location. The bolts 92 or lifting hardware in the top plate 26 are designed to easily raise the walls 12 and 22 such that the walls of the building can be quickly and efficiently installed relative to the stud wall structure. Finally, the walls can be quickly secured together, with prefabricated window and door frames such that the structure can be efficiently constructed in a short amount of time.

A foundation 100 that can be utilized with the walls 12 and 22 is illustrated in FIGS. 19-22. The foundation 100 includes a foam block 102 (typically EPS) of a desired length L, width W and height H. The foam block 102 typically has a height of about twelve (12) inches and a width of twenty four (24) inches and any desired length. However, the present disclosure is not limited a block of having a twelve (12) inch height and a twenty four (24) inch width. Rather any foam block having a sufficient size can be used provided the block of foam provides the necessary structural integrity.

Figure 23:
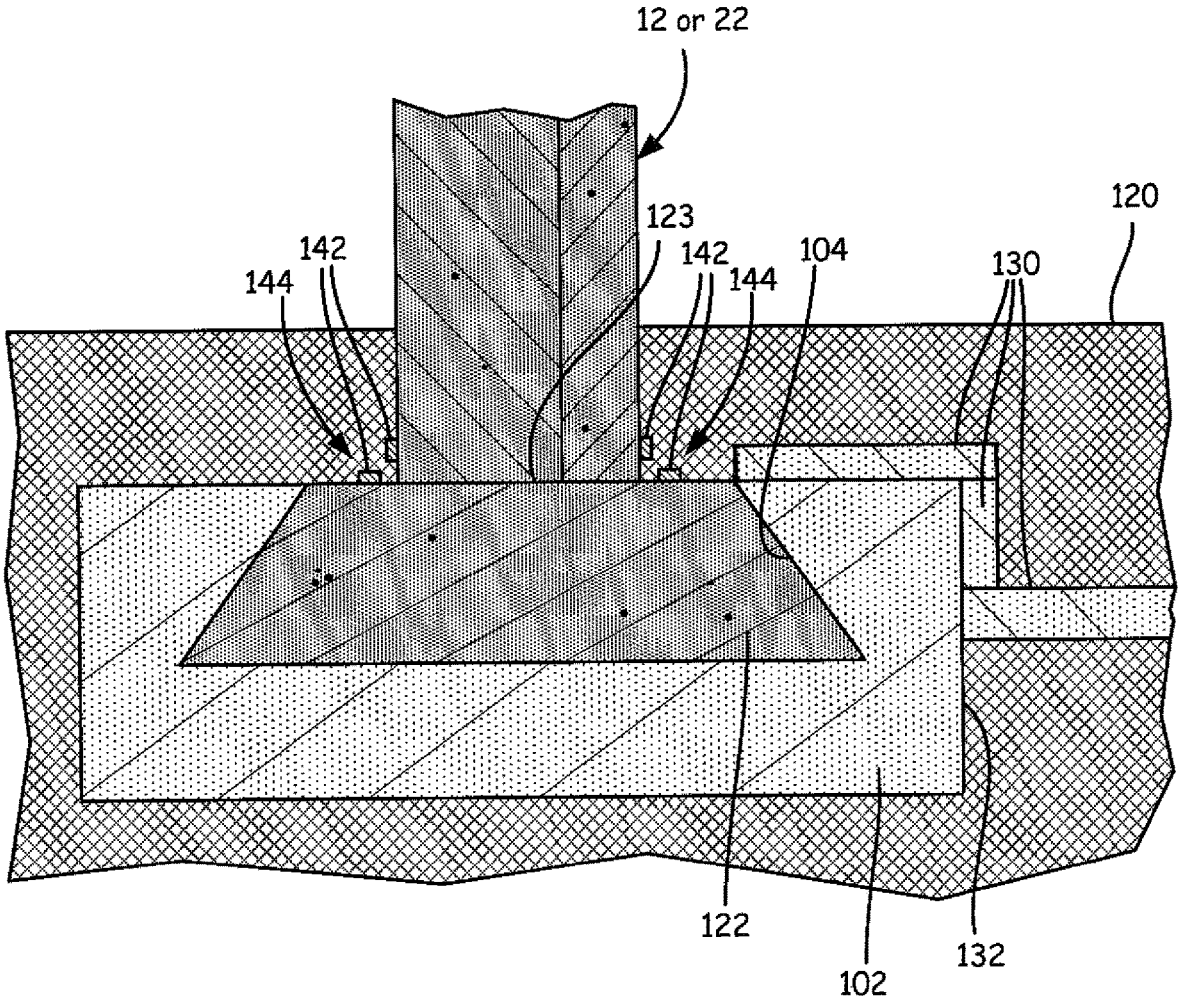
FIG. 23 is a schematic view of the foundation positioned within the soil and a wall secured thereto.
Figure 24:
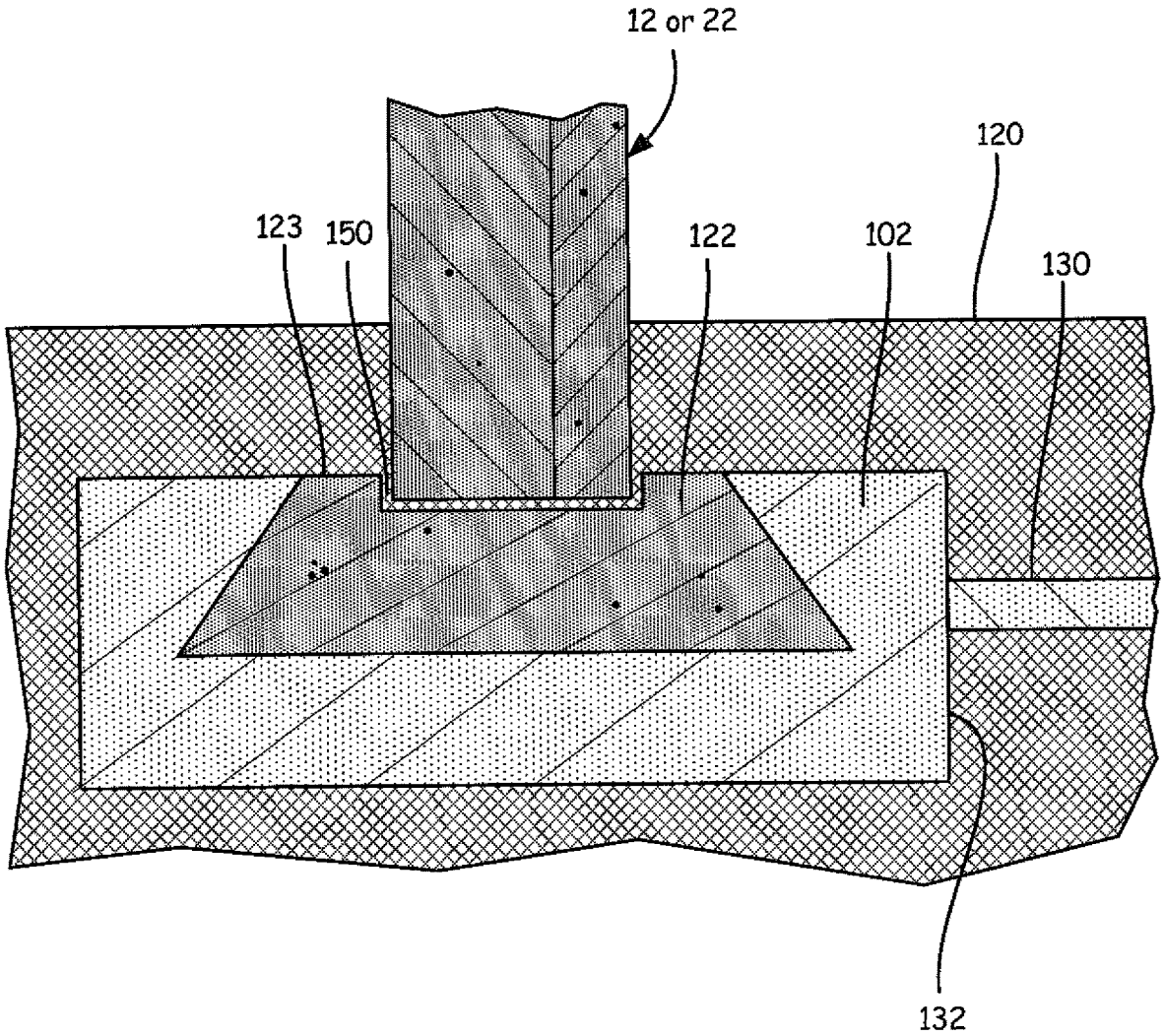
FIG. 24 is another schematic view of another foundation positioned within the soil and a wall secured thereto.

A dovetail channel 104 (as illustrated in FIGS. 23 and 24) is cut into the block from the top surface 105 and into the block approximately a distance one half of the height where the dovetail channel 104 extends from a left end 106 to a right end 108. A typical depth of the dovetail channel 104 is about 12 inches. However, other depths are contemplated.

The dovetail channel 104 defines a top portion 108 of a left and right end channel 110 and 111. The left and right end channels 110 and 111 have a dovetail configuration and extend from the top surface 105 to a bottom surface 112.

A form is positioned about the foam block 102 and concrete is placed to fill the dovetail channel 104 and the left and right end channels 110. The left and right channels 110 extend into the block 104 a selected distance such that a concrete surface 114 and 116 large enough to engage an earth anchor or pier after the concrete is placed and cured.

The end channels 110 are filled with concrete and form concrete vertical pilasters 124 and 126 that include the surfaces 114 and 116 that are capable of being placed upon a platform of an earth anchor, piling, pier or other support, if necessary. A top surface 123 of the pilaster 122 forms a portion of a perimeter of the foundation of the structure that supports the walls 12 and/or 22 of the structure Referring to FIG. 23, the foundation 100 is illustrated positioned within the soil a selected depth below ground level 120. The foundation 100 includes the foam block 102 and a concrete pilaster 122 having a dovetail cross section and a height that this approximately half of the height H of the block 104. The dovetail configuration of the pilaster 122 within the block aids in retaining the pilaster 122 within the foam block 104. While dovetail configured channels and pilasters are discussed and illustrated, any suitable configuration of the channels and pilasters for the foundation is also contemplated.

Once the foundations 104 are placed in position, insulation panels 130 are then place adjacent an outer vertical surface 132 of the foam block 104 about the entire perimeter of the structure. The insulation panels 130 are typically about 2 inches thick and about 48 inches in width (however other dimensions of the insulating panels are contemplated). The insulation panels, typically EPS foam, prevent frost and other climate factors from engaging the foundation and extend the life of the structure. However, the foundation 100 can be used at a depth that would not require the insulation panels 130.

The wall 12 or 22 can then be lifted onto a top surface 123 of the pilaster 122 and secured thereto with a fastening mechanism. Referring to FIG. 23, the fastening mechanism 140 includes metal strips 142 secured to the top surface 123 of the pilaster 122 and to the sides of the wall 12 and/or 22. An angle iron 144 is secured to the metal strips 122, typically with a weld. Utilizing the metal strips 142 and the angle iron 144 secures the wall 12 and/or 22 to the foundation 100.

Referring to FIG. 24, the wall 12 and/or 22 is secured to the foundation 100 with a securing mechanism that includes a channel 150 within the upper surface 123 of the pilaster 122 that is sized to a width and depth to accept a bottom portion of the wall 12 and/or 22. A concrete or adhesive can be used to secure the wall 12 and/or 22 with the channel 150 and thereby secure the wall 12 and/or 22 to the foundation 100 in a vertical position.

While a channel and concrete attaching mechanism and a weld between metal strips 142 with an angle iron 144 are illustrated, other securing mechanisms are also within the scope of the present disclosure.

The use of the disclosed foundation 100 and the walls 12 and/or 14 eliminates the need to dig and place footings and to build a foundation wall, typically out of cinder blocks. Therefore, a significant amount of time and expense can be eliminated from the construction of a structure utilizing the disclosed foundation 100 and walls 12 and/or 14.

Figure 25:
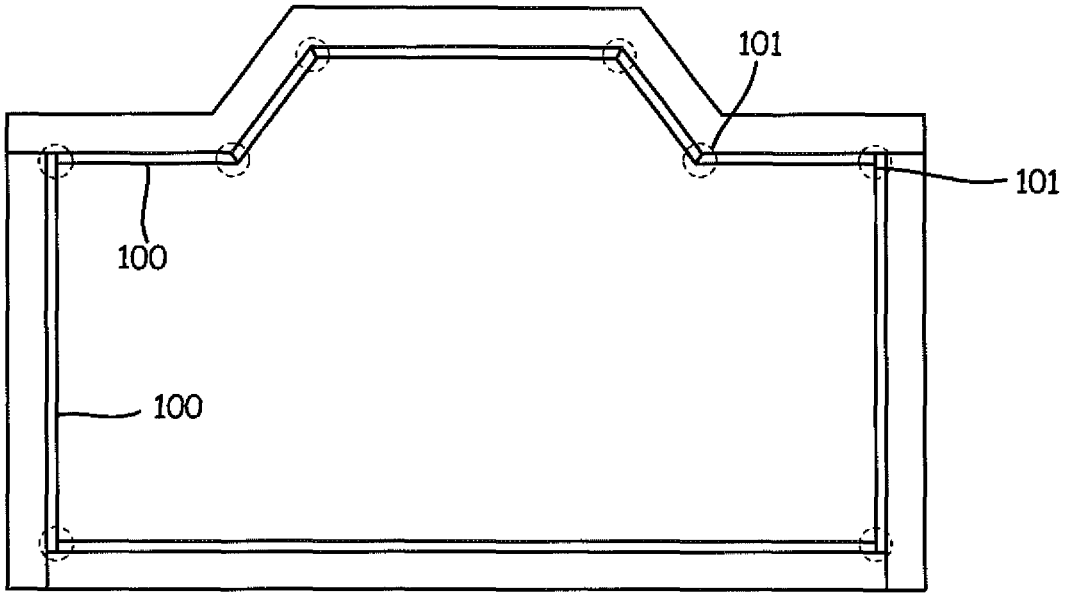
FIG. 25 is a schematic view of foundation forms creating a perimeter of a structure with piers located where foundations are positioned adjacent each other.

FIG. 25 schematically illustrates adjacent foundations 100 forming a footprint or perimeter of a structure wherein piers 101 are located under the adjacent ends of the foundations 100. A non-limiting example of a pier includes a bell shaped pier. A insulating layer 103 abuts the foundations and extends outwardly therefore to protect the foundations 100 from climatic factor such as frost.

Figure 26:
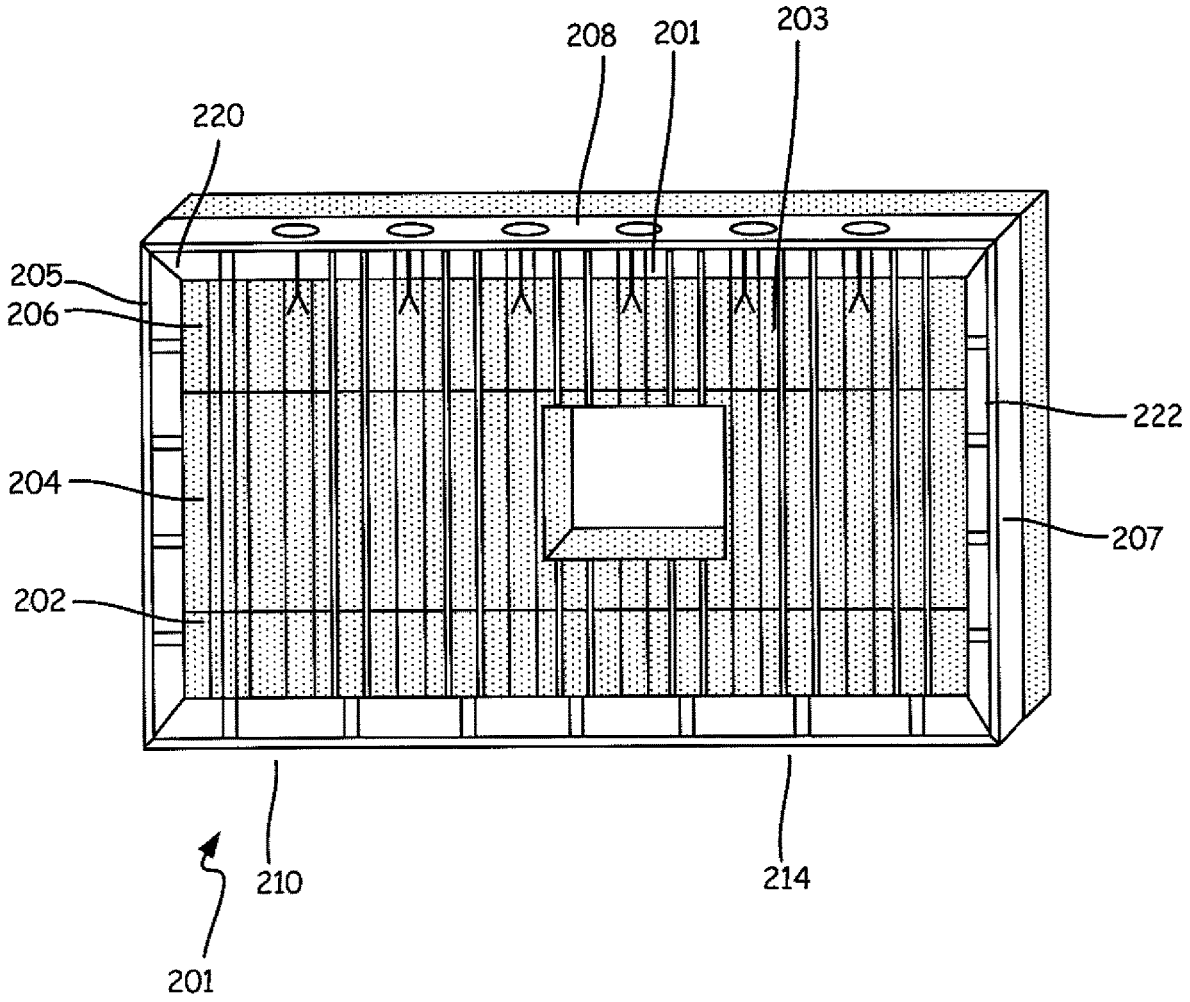
FIG. 26 is a schematic view of another embodiment of a wall having brackets defining edges of the concrete layer.
Figure 27:
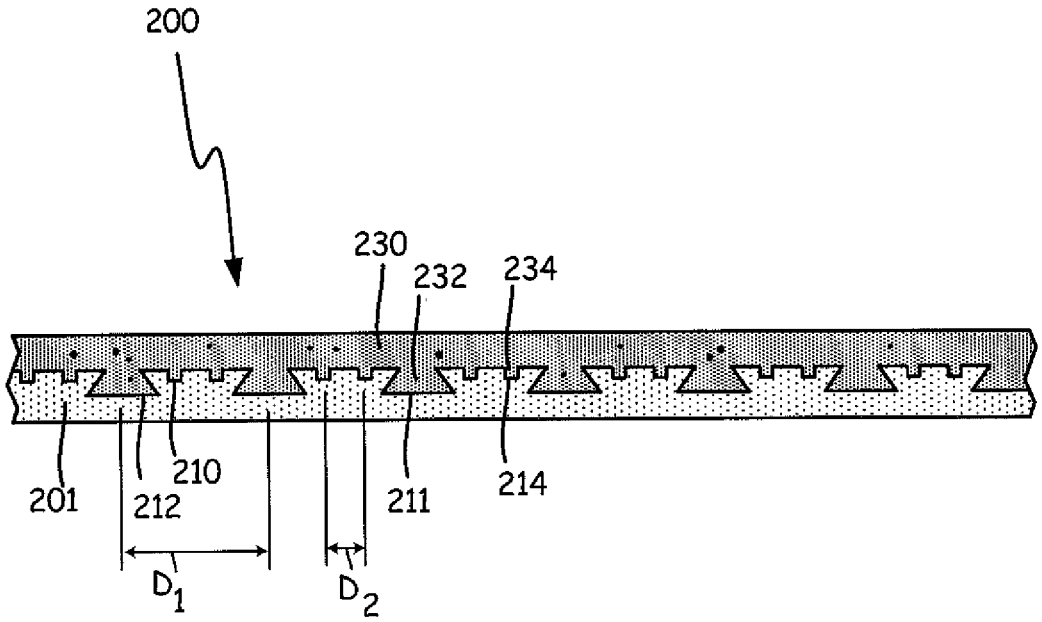
FIG. 27 is a cross sectional view of the wall illustrated in FIG. 26.

Referring to FIGS. 26 and 27 in another embodiment, a wall 200 includes a foam layer 201 formed using foam panels 202, 204 and 206 oriented such that seams between the panels 202, 204 and 206 are substantially parallel to upper and lower edges 208 and 210. As previously stated, orienting the panels 202, 204 and 206 with seams perpendicular to forces incurred when lifting prevents cracking of the concrete layer or wythe. As previously stated the foam layer 201 is typically a nominal six or eight inches thick. However, other thicknesses of the foam layer 201 are also contemplated.

A plurality of spaced apart channels 212 are cut into the foam layer 201 in a manner similar as described with respect to the channels 58 and 60. The plurality of spaced apart channels 212 have a dovetail cross-section and extend from the upper edge 208 to the lower edge 210 and rebar is positioned, as required by engineering specification, in the channels 212 as previously described. Alternatively, concrete fibers can be utilized instead of rebar. As illustrated, the channels 212 are spaced a distance D1 approximately thirty six inches to forty eight inches apart on center. However, any distance D1 is within the scope of the present disclosure. While a dovetail cross-section is illustrated, the channel can have other cross-sectional configurations. Rebar is positioned within the channels 212 as described for walls 12 and 22.

The foam layer 201 includes spaced apart grooves 214 that are substantially square or rectangular in configuration. The spaced apart grooves 214 extend into the foam layer 201 a distance less than the distance the channels 212 extend into the foam panel 201. The grooves 214 interrupt a bonding surface 203 of the foam panel 201 which results in better bonding between the foam panel 201 and a concrete layer or wythe when placed. As illustrated, the grooves 214 are spaced apart a distance D2 between about twelve inches and about 24 inches. However, any distance D2 is within the scope of the present disclosure. Also, while the grooves 214 are disclosed and illustrated herein, the grooves 214 are optional.

A left bracket 220 is secured to the foam layer 201 proximate a left edge 205 and along a length of the left edge 205 and a right bracket 222 is attached to the foam layer 201 proximate a right edge 207 and along a length of the right edge 207. The brackets 220 and 222 are configured to withstand forces imparted by placed concrete, provide a screed surface for leveling the placed concrete and provide a finished surface for securing adjacent walls together. The bracket 220 provides a finished surface or edge to the panel or wall surface.

A bottom bracket 224 is secured to the foam layer 210 proximate the bottom edge 210 and a top bracket 226 is secured to the foam layer 201 proximate the top edge 208 where both brackets 224 and 226 extend along a length of the respective edge. The brackets 224 and 226 are configured to withstand forces imparted by placed concrete, provide a screed surface for leveling the placed concrete and provide a finished surface for securing adjacent walls together.

Each bracket 220, 222, 224 and 226 includes a top edge that is substantially even where a distance from the top edge of the bracket 220, 222, 224 and 226 to the bonding surface 203 of the foam layer 201 defines a thickness of a wythe 230 of concrete that forms the wall 200.

When placed, the concrete fills the channels 212 and grooves 214 to form pilasters 232, 234 where the dovetailed pilasters 232 are utilized for structural integrity and the smaller pilasters 234 are provide additional bonding between the wythe 230 and the foam layer 201. As described in more detail below each bracket 220, 222, 224 and 226 has a flat member that extends in a direction substantially parallel to the bonding surface 203 of the foam layer 201 which provides as surface to screed the wythe 203. The use of the brackets 220, 222, 224 and 226 allows the wall to be formed with a finished outer surface of the wythe 230 and finished edges and therefore the wall 200 will require minimal, if any finishing work prior to installation.

Figure 28:
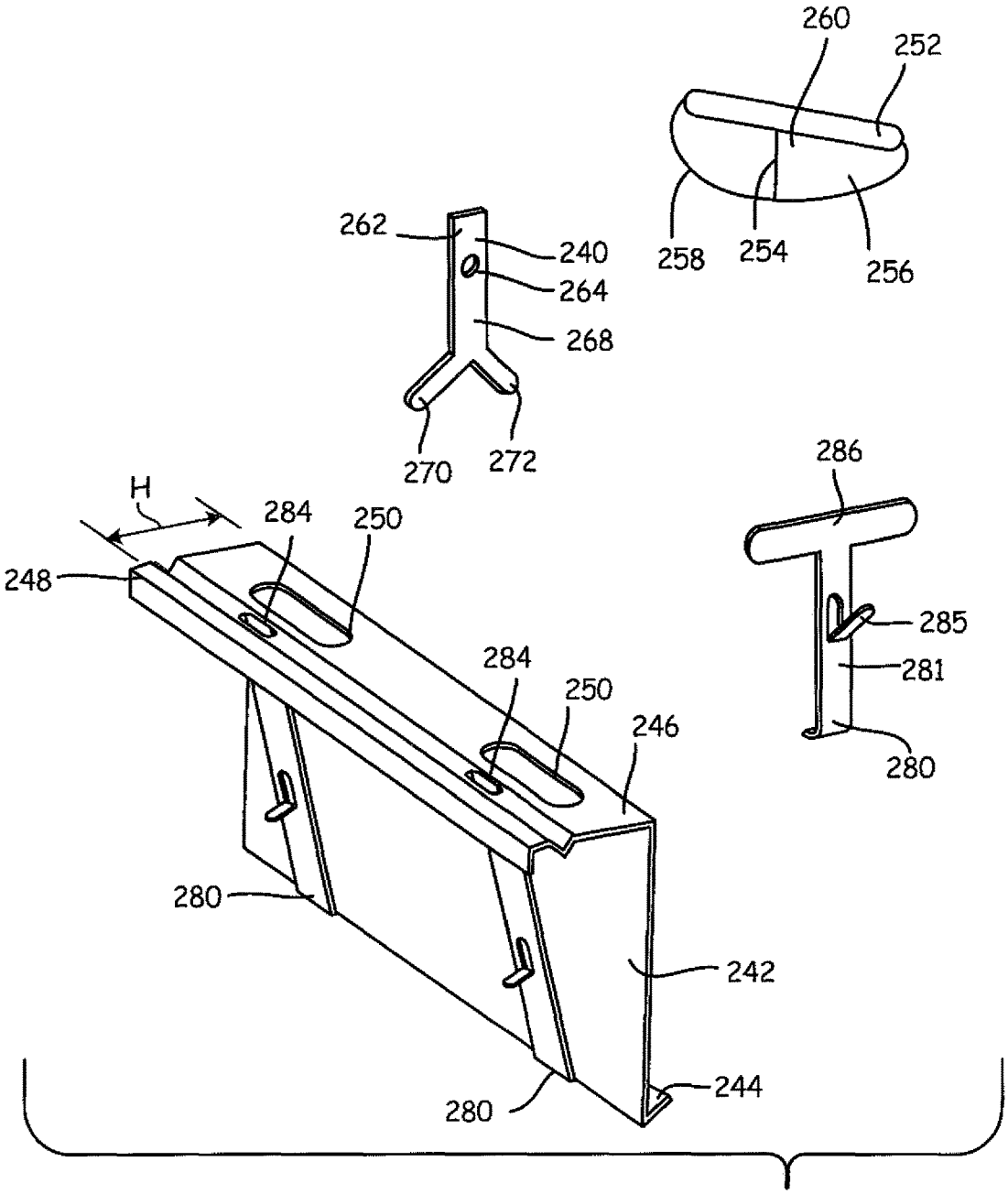
FIG. 28 is an exploded view of a bracket with a lifting mechanism.
Figure 28A:
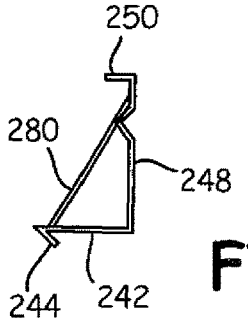
FIG. 28A is a side view of the bracket illustrated in FIG. 28.

Each bracket 220, 222, 224 and 226 are utilized to different purposes. Referring to FIGS. 28 and 28A, the bracket 226 is utilized to form the upper edge of the wall 200 while retaining lifting mechanisms 240 thereto such that when the concrete wythe 230 is placed the lifting mechanisms 240 are securely encased in the wythe 230 and provide sufficient support to enable a cable or chain to be attached thereto for a lift from a horizontal portion to a substantially vertical position and onto foundation 100.

The bracket 226 includes a bottom portion 242 that is substantially flat and is configured to abut the bonding surface 203 of the foam layer. An angled tang 244 extends from one edge of the bottom portion 242. The angled tang 244 is configured to be positioned within a slot foam layer 201 where the slot has substantially the same angle. The angle is acute and is in the range of 20 degrees and about 60 degrees. A typical angle is about 30 degrees. The engagement of the tang 244 with the slot prevents movement toward the upper end 208 of the foam layer when the concrete is placed. The bottom portion 242 can be secured to the bonding surface 203 with a layer of adhesive.

The bracket 226 includes a wall 246 that extends from another edge of the bottom portion 242. The wall 246 has a height H from the bottom portion 242 that defines the thickness of the wythe 230. A screed portion 248 extends from the wall 246 wherein the screed portion 248 is substantially parallel to the bottom portion 242 such that the placed concrete can be screeded using the brackets 220, 222, 224 and 226.

The wall 246 includes spaced apart apertures 250 that are configured to allow access to the lifting mechanism 240 when encased within the wythe 230. Prior to placing the concrete, an end cap 252 having a similar perimeter to that of the aperture is positioned through the aperture. The end cap 252 has a slot 254 that separates end cap halves 256, 258 that are secured together with a living hinge 260. The slot 254 is spread apart and a top portion 262 of the lifting mechanism 240 having at least one aperture 264 therein is positioned within the slot 254. The end cap halves 256, 258 are forced together to frictionally secure the end cap 252 about the top portion 262 of the lifting mechanism 240.

The end cap 252 is then secured within the aperture 250 in the wall 246 such that the lifting mechanism 240 is retained in a selected position. The lifting mechanism 240 includes a main portion 266 between the top portion 262 and the bottom portion 268. The bottom portion includes arcuate members 270, 272 that function as an anchor to prevent the lifting mechanism 240 from being pulled through the top portion of the wall 200 as the wall 200 is lifted. While arcuate anchor members 270, 272 are illustrated, other types of anchor configurations can be utilized.

The end cap 252 can also be utilized in different applications such as, but not limited to, providing access to a tightening mechanism secured to cables within the concrete wythe such that the concrete can be post tensioned. Post tensioning the concrete allows the structure to be utilized in different applications, such as, but not limited to a floor panel.

The lifting mechanism 240 is typically of a monolithic construction where a material of construction is steel. However, other material of construction besides steel is contemplated for the lifting mechanism 240.

Once the concrete is placed and cured, the end cap 240, having a low surface energy, is removed to provide access to a void in the wythe 230 which provides access to the aperture 264. Cables or chains can then be secured to spaced apart lifting mechanism 240 to lift the wall 200.

Prior to placing the concrete, spaced apart braces 281 are secured in spaced apart slots 282 in the bottom portion 242 and spaced apart slots 284 in the wall 246. An area of the slots 282 and 284 are minimized to prevent concrete from flowing therethrough. The braces 281 include a "T" shaped end 286 that is wider than the slot 284 wherein one portion of the "T" shaped end 286 is position through the slot 284 followed by the other portion. A typical slot 284 is a coin slot opening, which prevents concrete from flowing through the slot. The portions of the "T" shaped end 286 prevent the end 286 from sliding through the slot 284. The brace 281 includes a hook shaped end 288 that is configured to engage the slot 282 in the bottom portion 242.

With the "T" shaped end 286 positioned through the slot 284, manual force is placed onto the brace 281 which causes the bracket 240 to flex and cause the wall 246 towards the bottom portion 242. The hook shaped end 288 is then positioned the slot 228 and when the force is released the brace 281 is in tension, which provides a counteracting force to the force of the placed concrete on the wall 246. As such, the wall 246 is retained in the selected position when the concrete wythe 230 is placed.

The brace 281 includes a tab 283 that extends outwardly therefrom. The tab 283 allows rebar or other materials to be secured to the brace. The rebar can be utilized to retain the lifting mechanisms 240 in the selected portion.

Figure 29:
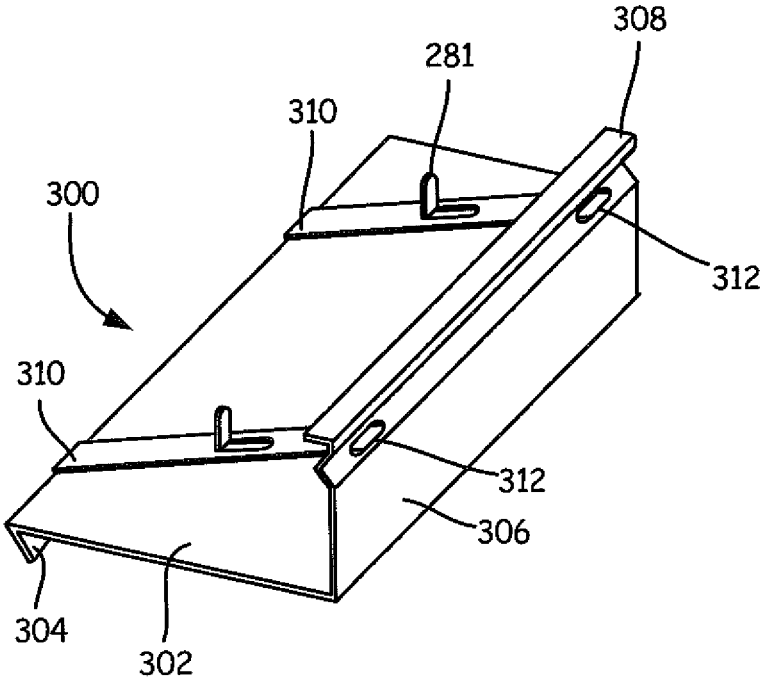
FIG. 29 is a perspective view of a bracket with a right angle.
Figure 29A:
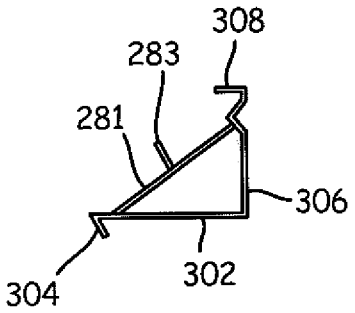
FIG. 29A is a side view of the bracket illustrated in FIG. 29.

Referring to FIGS. 29 and 29A, a similar bracket 300 to that of bracket 240 is illustrated. The bracket 300 includes a bottom portion 302, angled tang 304, substantially vertical wall 306 and a screed portion 308 that is substantially parallel to the bottom portion 302. The bottom portion 302 includes slot 310, similar to slot 280 in the bracket 240, and slot 312, similar to slot 282 in the wall 246, such that the same brace 281 can be utilized. The slot 312 is located within a channel 313, that is angled from the wall 313. The channel 313 defines corners into which an adhesive placed when walls are secured together. The corners in the adhesive created by the channel 313 prevent air and moisture penetration. A similar process is used to install and secure the bracket 300 to the foam layer 201 relative to the bracket 240. The bracket 240 is typically used on the bottom portion of the wall 202, but can be used on any edge of the wall 200.

Figure 30:
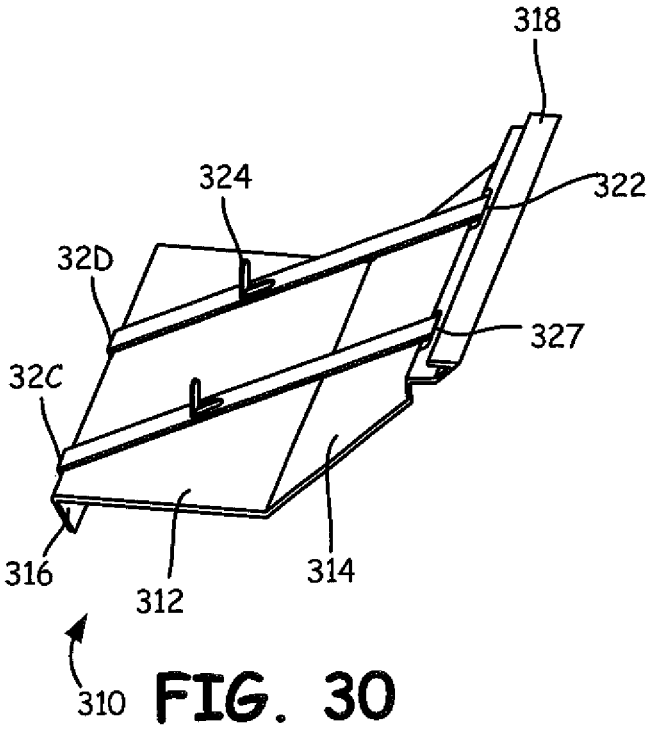
FIG. 30 is a perspective view of a bracket with a 135 degree angle.
Figure 30A:
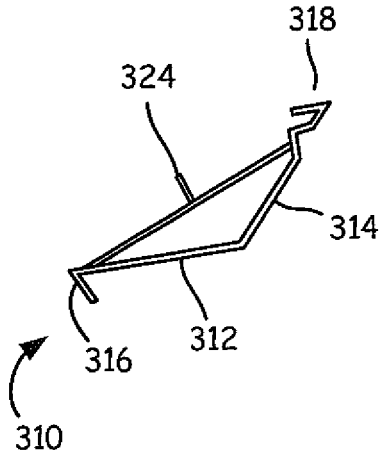
FIG. 30A is a side view of the bracket illustrated in FIG. 30.

The left and right edges 205 and 207 are typically at an angle such that when adjacent walls are secured together, a single seam is formed. Typically the angle of the structure is determined and bisected such that the walls 200 have abutting surfaces having the same lengths and dimensions. For instance when two walls are joined to form a 90 degree corner, a bracket 310 having a wall 314 having a 135 degree angle relative to the bottom portion 312 is utilized as illustrated in FIGS. 30 and 30A. The bracket includes an angled tang 316 and a screed portion 318, as previously described.

The bracket 310 includes spaced apart slots 320 in the bottom portion 312 and spaced apart slots 322 in the wall 314. Braces 324 having a similar configuration to the brace 281 are utilized wherein the ends of the brace 324 are installed in the slots 320 and 322.

Figure 31:
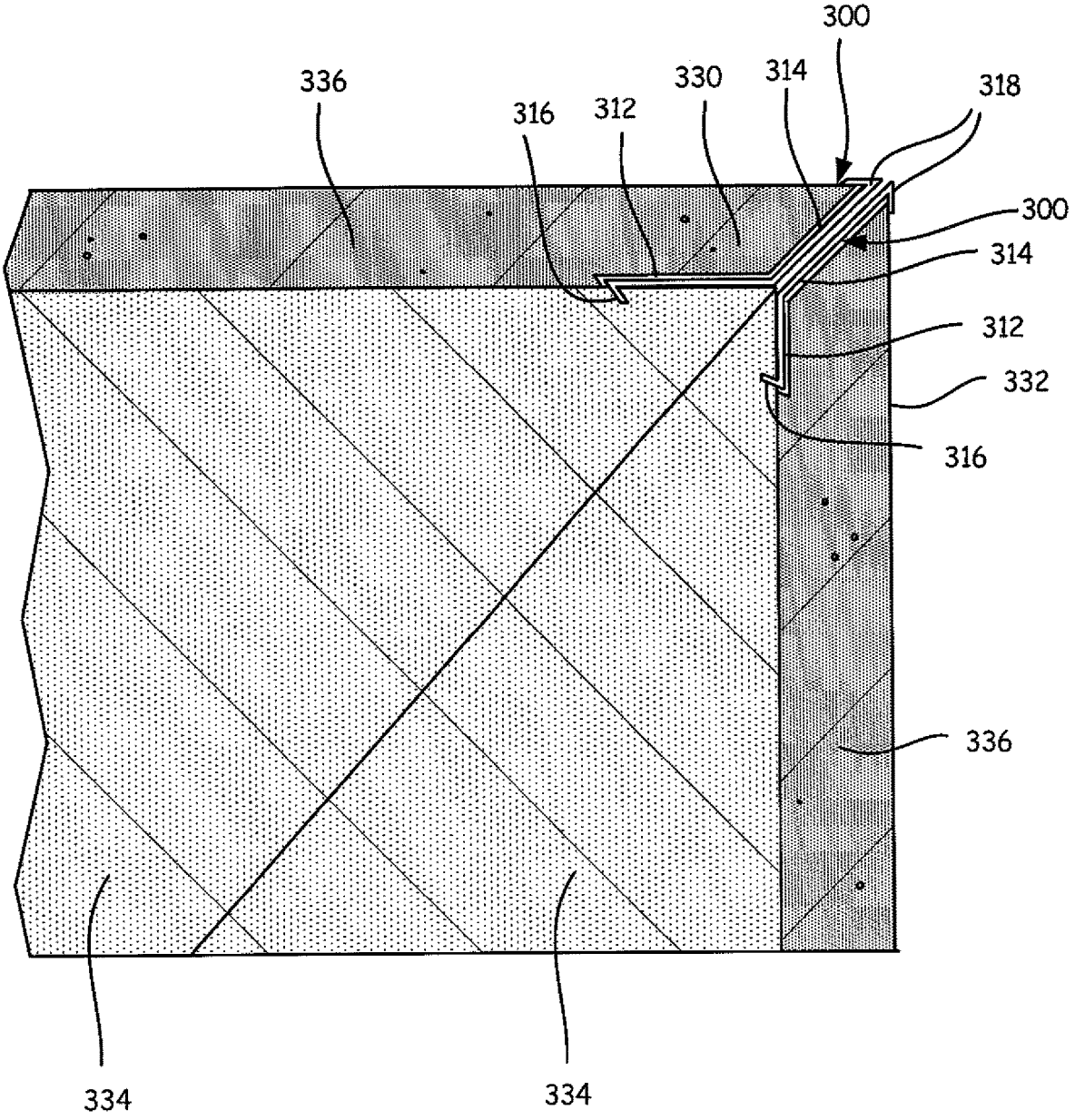
FIG. 31 is a schematic view of a wall joint with an exterior ninety degree angle.

FIG. 31 is a schematic of two walls 330 and 332 joined at a 45 degree angle using the bracket 310. Each wall 330, 332 is constructed as describe with respect to wall 200 and includes the foam layer 334 and the concrete wythe 336. Each wall 330, 332 includes the bracket 310 and the foam layer 334 is at the same angle as that of the wall 314.

While a 90 corner and a 135 degree angled corners are illustrated, other common angles for the walls of the wall relative to the bottom portion of the brackets include an angle of 22.5 degrees for a bay treatment, 90 degrees for butted walls and 135 degrees for outer bay treatments. Further, a bracket with a forty five degree angled wall can be used for inside corners.

The wall 314 of the bracket 310 is located between about one eighth to one quarter of an inch form the foam surface 334 on the wall 330 and the wall 314 of the bracket 310 is positioned between about one eighth of an inch to about one half of an inch from the angled foam surface 334 on the wall 332 to provide a gap between the brackets 310. A typical gap is between about one quarter of an inch and about one half of an inch.

An adhesive layer is positioned in the void between the angled foam surface 334 and the wall 314 to substantially fill the void. A typical adhesive is a pre-compressed joint sealant. One such pre-compressed joint sealant is sold under the WillSeal® trade designation by WillSeal located in Hudson, N.H. However any suitable adhesive or sealant is within the scope of the present application. As the walls 330, 332 are positioned proximate each other, the adhesive securely joins the two edges to secure the walls 330, 332 together.

Figure 32:
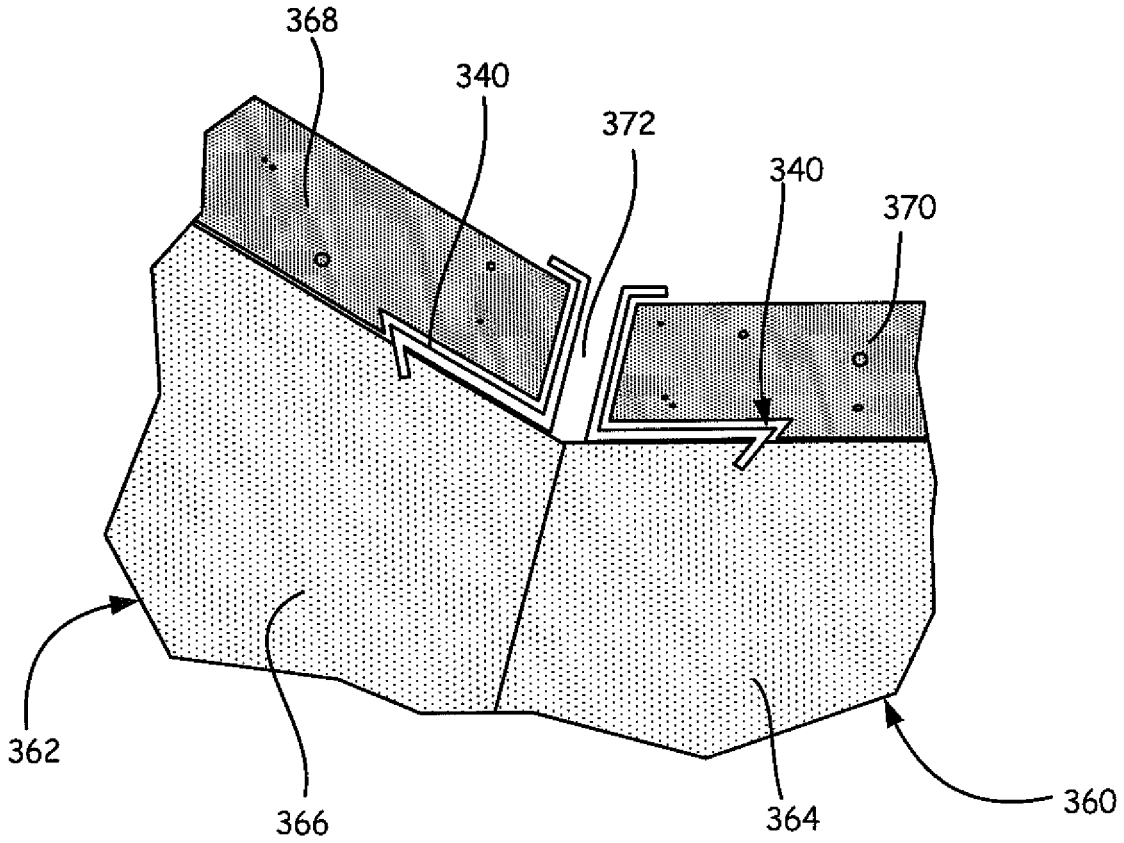
FIG. 32 is a partial schematic view of two wall secured together.

Referring to FIG. 32, two walls 360, 362 are joined to form a 135 degree angle using the brackets 340. The walls 360, 362 include foam layers 364, 366 and concrete wythes 368, 370 along with brackets 340. The bracket 340 is secured flush with the surface of the foam layer 366 of the wall 362 while the bracket 340 is secured a distance from the surface of the foam layer 362 of the wall 360 where the distance is typically between about one eighth of an inch and about one half of an inch. An adhesive layer 372 is positioned in the void between the walls 344 and when the walls 360, 362 are positioned next to each other, the adhesive layer 372 secures the walls 360, 362 together.

Figure 33:
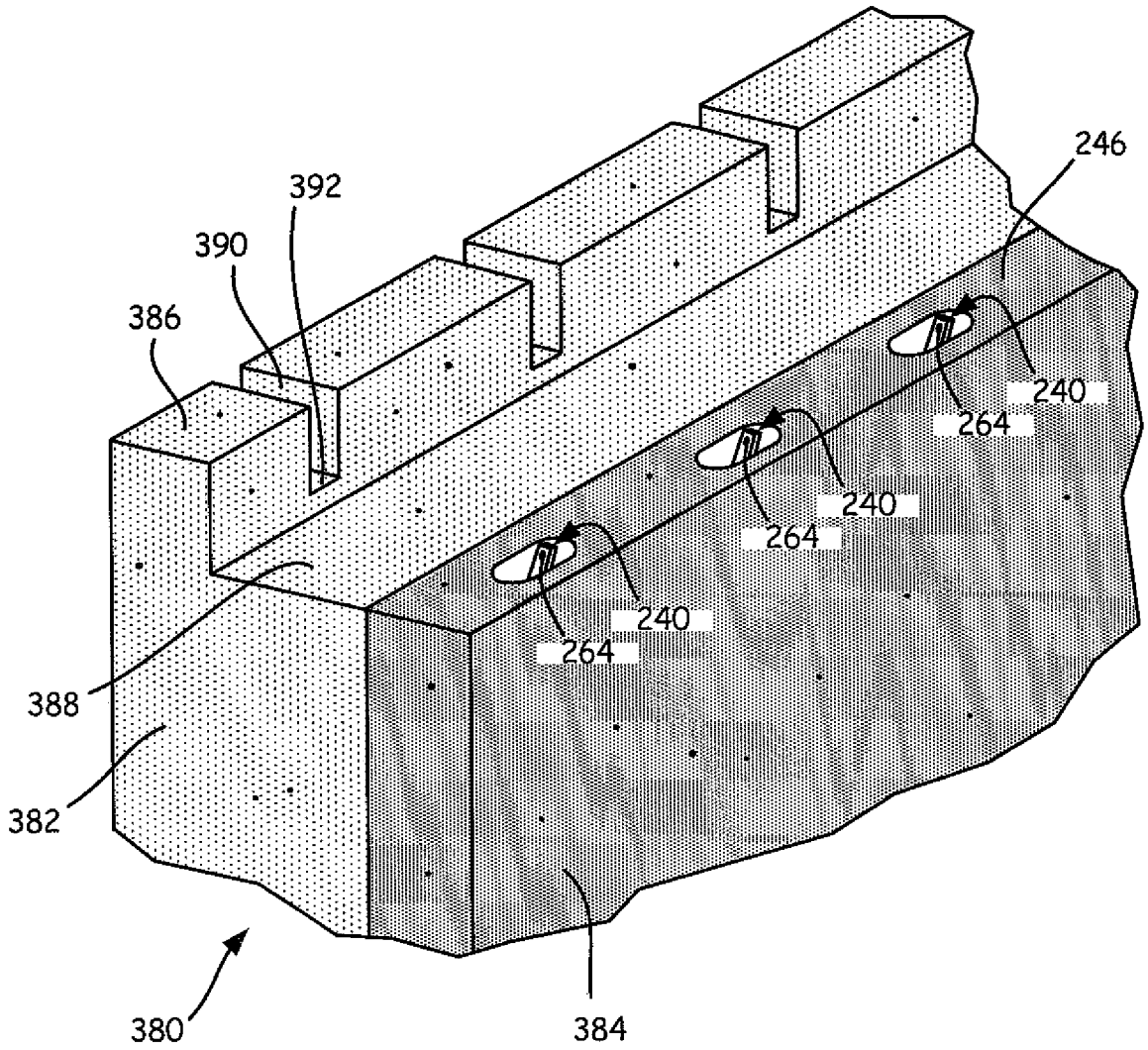
FIG. 33 is a partial perspective view of a wall with channels in the foam layer configured to accept rafter or ceiling beams.

Referring to FIG. 33, another embodiment of a wall 380 is illustrated and is constructed as described with respect to the wall 200. For purposes of clarity, only top bracket is illustrated where aperture 264 within lifting mechanism 240 is illustrated. The wall 380 has a modified foam layer 382 relative to the foam layer 201 of the wall 200. The wythe 384 is similar that of the wythe 230.

The foam layer 382 includes an upper portion 386 that extends above a surface 388 that is substantially flush or even with the wall 246 of the bracket. The upper portion 386 extends a length of the foam layer 283 and has spaced apart channels 390 having a bottom surface 392 located above the surface 388. The channels are configured to accept a rafter beam or ceiling beam and are spaced apart to accept the rafter beam or ceiling beam per the building specification. An insert 390, typically metal with a "U" shaped channel, can be installed to provide additional strength to the foam layer 382, although the insert is not required. Preforming the foam layer 382 with the channels 390 decreases the amount of time and labor required to build a structure as the rafter beams or ceiling beams can be adhered within the channels. 390. Optionally, a complementary piece of foam (not shown) with similarly spaced apart channels can be installed on the surface 388 once the wall 380 is in the raised position to extend a length of the channels 390 and provide more stability to the rafter beam or ceiling beam secured within the channel 390.

Figure 34:
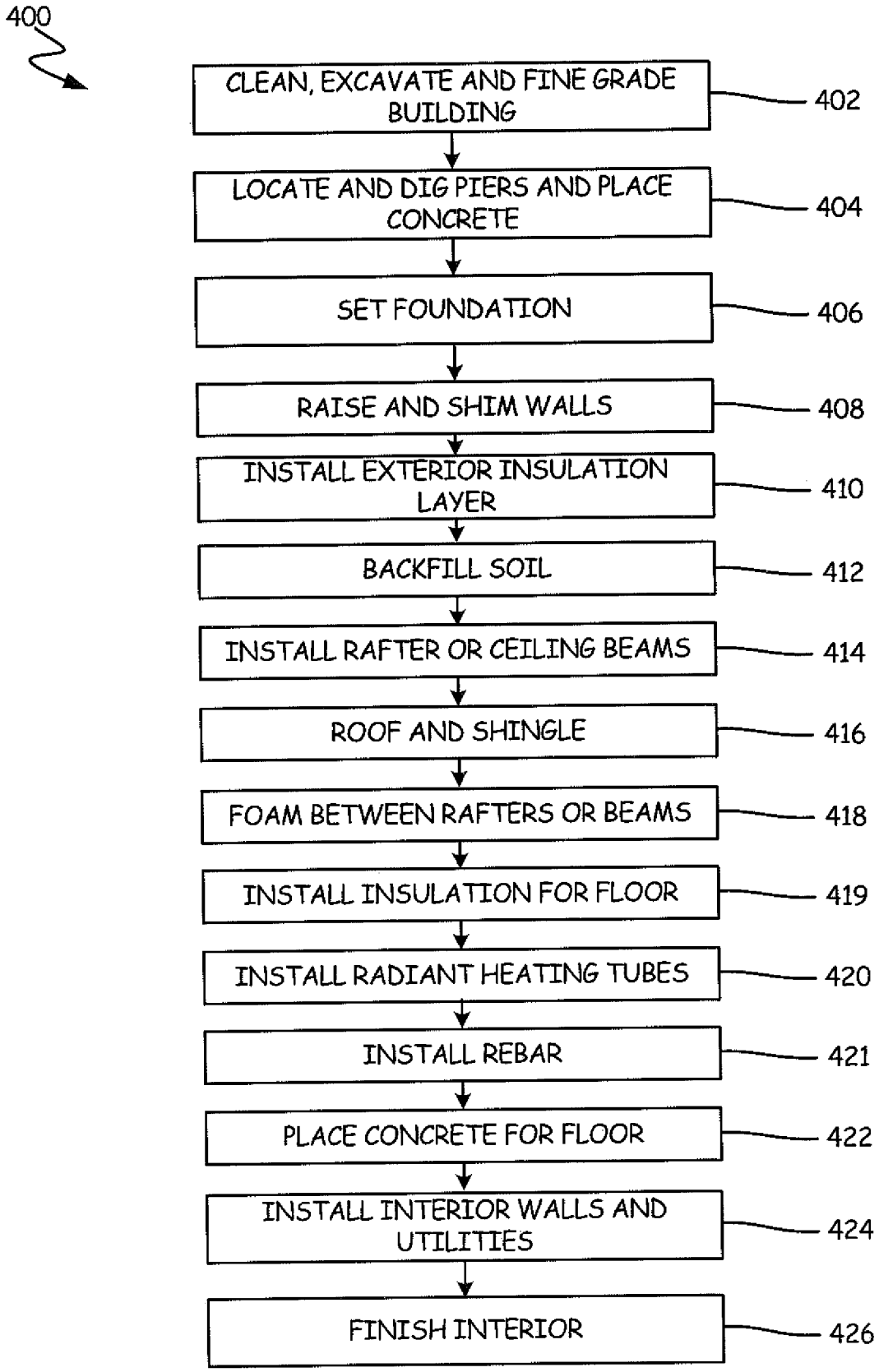
FIG. 34 is a flow chart of an exemplary building method.

A method 400 of constructing a building is illustrated in FIG. 34. The method includes step 402 of clearing a location for the building, excavating the necessary soil to the proper finished grade, digging in the pier in selected locations about a footprint or perimeter of the building and to locate foundations and insulation. In step 404 piers are positioned into the ground at selected elevations and locations where foundation about such that ends of adjacent foundations are supported by the pier. It is contemplated that each pier having an upper surface that is at substantially the same level such that the foundation will be level. An exemplary pier is a bell shaped pier however other styles of piers are also contemplated. After the piers are created in the soil, the interior can be vacuumed to remove loose soil and the concrete is placed into the interior of the foundation.

At step 406 the foundations as previously described herein are positioned on the soil such that the soil supports the foundation along its length and end portions are supported by the piers. Once installed, the foundations provide a perimeter or footprint of the building.

At step 408, the preformed composite foam and concrete walls 12, 22, 200 or 380 are raised and set onto the respective foundation and secured together at the respective side edges with adhesive. The walls 12, 22, 200 or 380 are shimmed at the interface with the foundation when necessary to cause the upper surfaces of joined walls to be substantially even. A bottom portion of the wall is then secured to the foundation. A top surface of the adjacent walls can be joined together with any suitable bracket.

At step 410, insulating layers are posited about the foundation and outwardly from the foundation. The insulating layer prevents frost and other environmental factors from affecting the foundation. At step 412, soil is back filled over the foundation, insulating layer and the bottom portion of the wall.

At step 414, rafters and or ceiling beams are installed. The rafter or ceiling beams are typically installed with walls 380 having the channels 390 for accepting the beams or rafters. However, the ceiling beams and/or rafters can be secured to a top beam as illustrated with walls 12 and 22. The ceiling beams and rafters can optionally be constructed from LSL.

At step 416, another story or the roof is installed and shingled. A preferred roofing system is a metal roof manufactured by Gerard Roofing Technologies located in Brea, Calif. At step 418, foam is positioned between the rafters or ceiling joints and a ceiling material is installed.

At step 419, an insulation layer is installed within the footprint of the building. A typical thickness of insulation is between about 4 and 10 inches, depending upon local building codes.

At step 420, rebar is positioned above the insulating layer and ends of the rebar are tied to the wythe in the exterior wall. Optionally, a radiant heating system can be installed and then a slab concrete is placed within the foot print of the building.

At step 424, interior walls and utilities are installed. At step 426, the interior of the building is finished.

Figure 35:
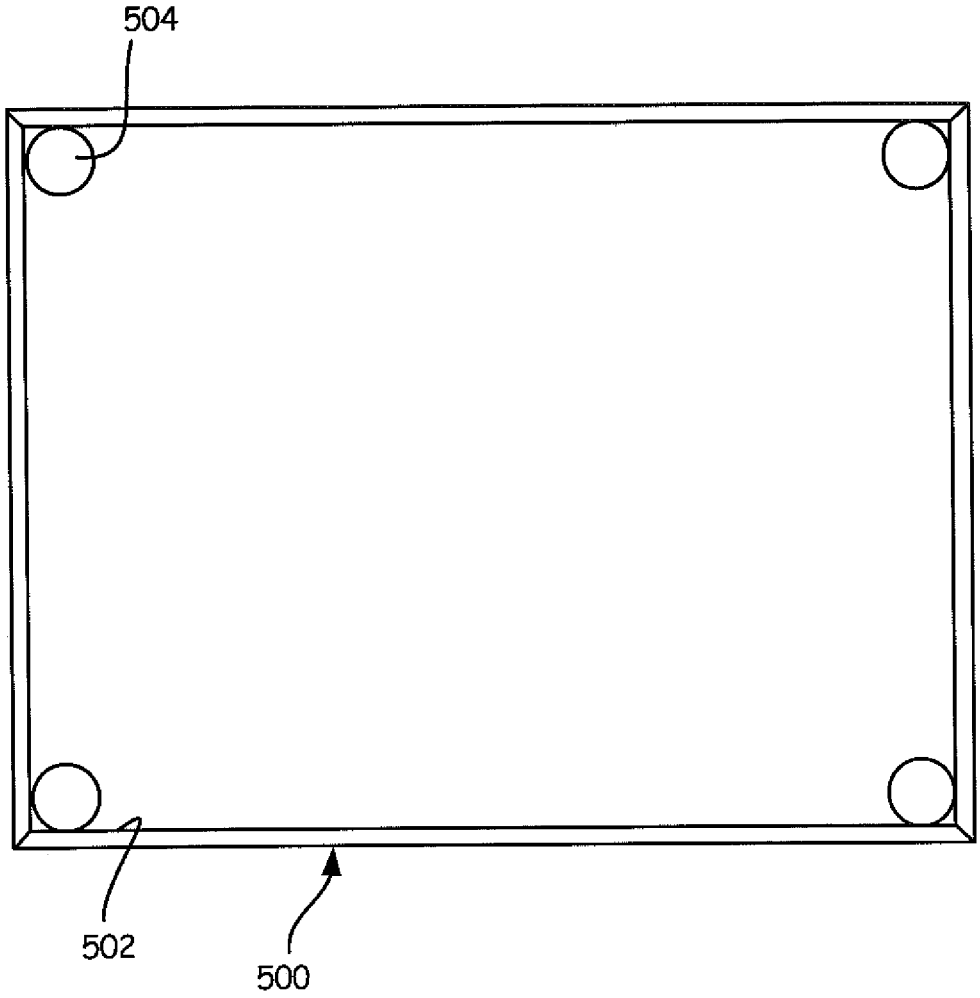
FIG. 35 is a schematic view of batter boards defining a perimeter of a structure and holes for piers of a structure.

In another embodiment, an area of land is leveled in preparation for a building to be constructed. Underground services including, but not limited to, sewer and water and optionally electrical are installed and the associated trenches are then compacted to a required density. Referring to FIG. 35, batter boards 500 are set for a perimeter 502 of the building and a nominal one inch to a nominal two inches of sand is placed on the leveled soil within the space defined by the batter boards and compacted to a building code for the area.

The soil is excavated and graded for a selected distance beyond the perimeter. The soil is excavated and graded to support a foam layer that provides frost protection to the foundation.

Holes 504 for piers are then drilled in locations where two foundations meet. Loose soil is removed from the holes 504 and the base of the hole is compacted. Once the holes 504 are drilled and the soil is removed, foam portions of the foundations are positioned about a perimeter of the structure.

Figure 36:
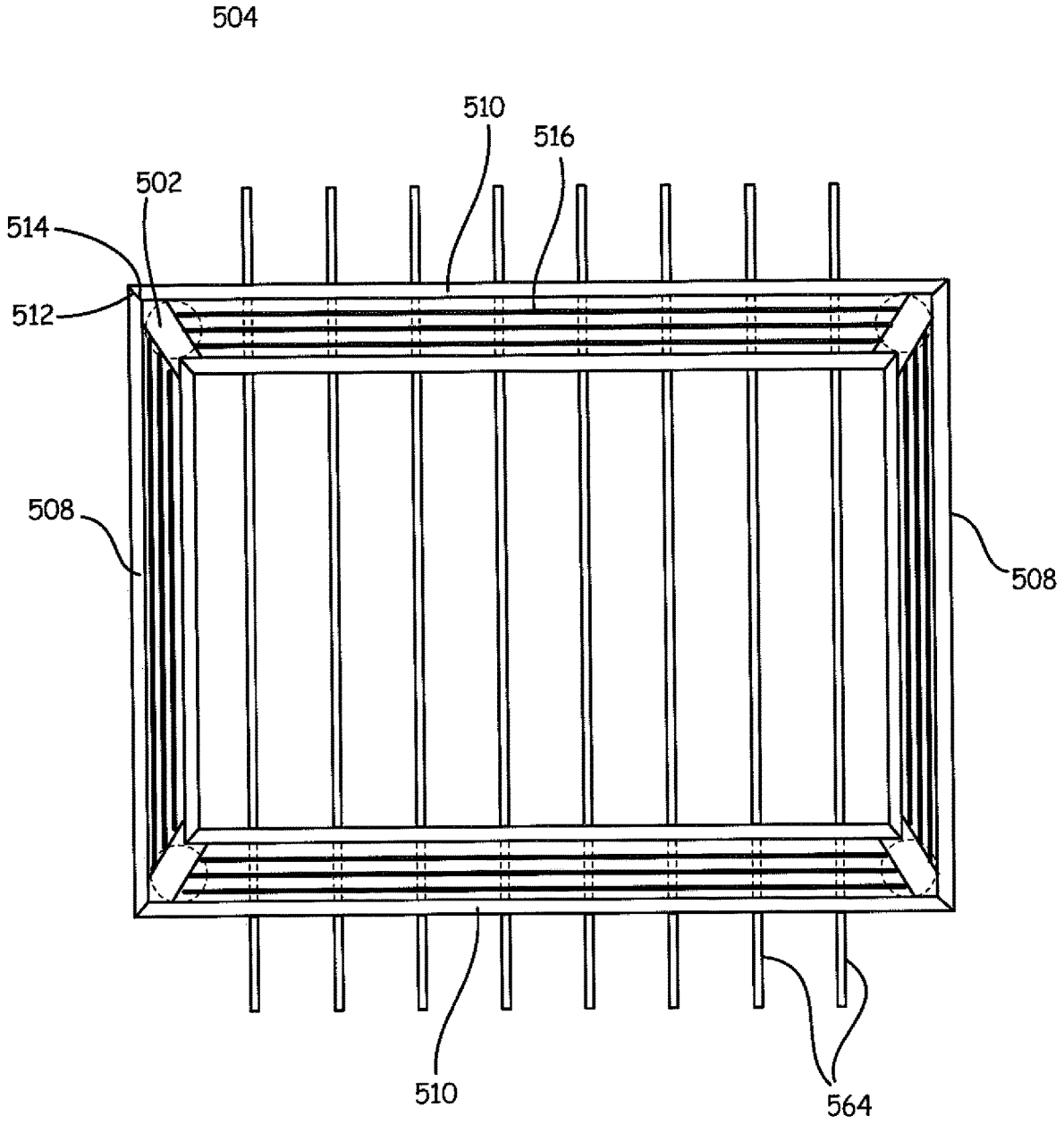
FIG. 36 is a schematic view of holes for piers, foam portions of foundations defining a perimeter of the structure and a drainage grid for the structure.

Referring to FIG. 36, abutting ends 512, 514 of the foundations 508, 510 are configured to have an angled surface that abut each other. For instance in FIG. 36 a right angled corner is illustrated where the abutting ends have forty five degree surfaces. Depending upon the angle of the corner, the angle is bisected to determine the angle of the abutting edges of the foundations.

Figure 37:
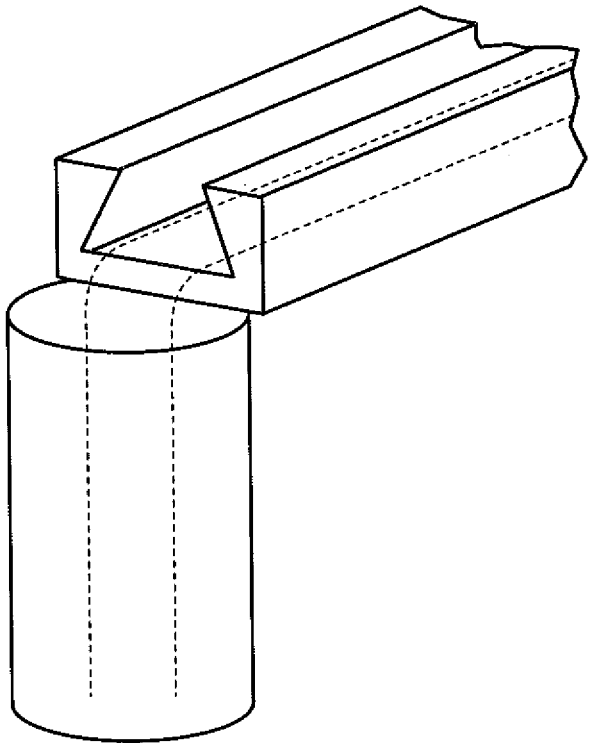
FIG. 37 is an enlarged view of a portion of FIG. 36.

Referring to FIGS. 36 and 37, rebar 516 is positioned in a top channel 518 of the foundations 508, 510. Rebar also bridges the two abutting 512, 514 surfaces and from the top channel 518 and into the holes 502 for the piers. Once the entire perimeter is completed, the foundations 508, 510 form a continuous top channel 518 and end slots 520 in the foam provide an opening to the drilled holes 502.

Concrete is then placed into the top channel 518 and fills the holes 502 to form the piers for the foundations 508, 510. Because the concrete is placed into the foundations 508, 510 and into the holes 502 to form the piers when cured, the concrete is of a monolithic construction that provides additional strength to the structure.

Once the concrete has cured, the walls can be raised and secured to the foundations as previously described. Alternatively, the walls can be formed using an alternative construction.

Figure 38:
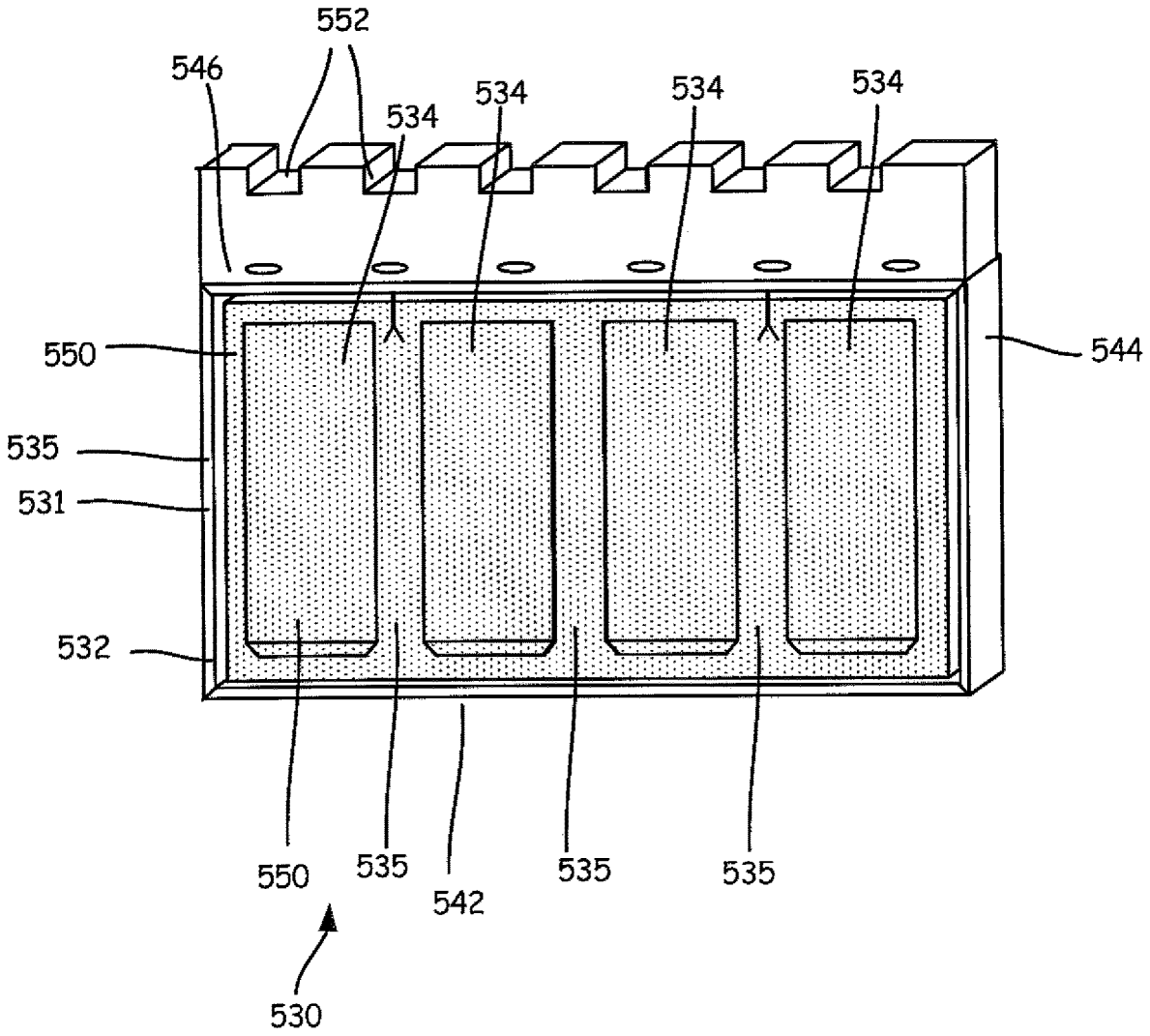
FIG. 38 is a view of a foam portion of a wall constructed with two layers of foam.

Referring to FIG. 38, in the alternative construction, a wall 530 can be formed by providing a first panel 532 having a desired thickness, typically between two inches and six inches in thickness. The first panel 532 is constructed as previously described where the seams between the first panels is substantially perpendicular or normal to stresses incurred during a lift, such as a tilt lift. The first panel 532 has substantially flat top and bottom surfaces 531 and 532 and optionally holes are cut through the thickness of the panel for window and doors as previously described.

Brackets 540, 542, 544 and 546 are secured about the perimeter of the first panel 532 with an adhesive. The brackets 540, 542, 544 and 546 are similar to the brackets 220, 222, 224 and 226 previously disclosed. However because an adhesive is utilized, the tang is not required to retain the brackets 540, 542, 544 and 546 to the first panel 532. To install the braces of the brackets 540, 542, 544 and 546, a groove is cut into the top surface 531 to provide sufficient space to secure the brace to the bottom member as previously discussed. Because a minimal amount of material is removed, the first panel has improved structural strength relative to the panel having the angled slots for accepting the angled tang.

Channels 535 that define the pilasters are formed by securing a second layer 534 having spaced apart portions to the first layer 532 with an adhesive. As previously disclosed, the second portions form dovetailed channels for forming the concrete pilasters. However, the portions of the second layer can provide any desired configurations.

With the braces and the portions of the second layer secured to the first layer, the concrete is placed onto the exposed surfaces of the first and second layers. The braces are utilized as a screed surface as previously disclosed.

The bottom surface 533 of the first layer 532 includes a fire resistant layer of material. A typical material of construction is Sold under the DENSILITE trade designation. However, the present disclosure is not limited to this material.

The walls 530 are secured together as previously described. Once the exterior walls are in place on the concrete in the foundation, ceiling beams, trusses and/or rafters are secured within spaced apart slots 552 in the top edge of the first panel 532. Inserts may optionally be secured within the slots between the first panel 532 and the ceiling beams and/or rafters to provide increased structural integrity.

Once the ceiling beams, trusses and/or rafters are installed, a foam layer is positioned between the ceiling beams and/or rafters. The foam layers provide insulation and can also reduce the transmission of sound between stories of the structure. If required, a sheeting can be installed above the ceiling beams, trusses and/or rafters.

In some instances, electric wiring is placed on an upper surface of the ceiling beams and or stringers of the rafters. One or more through bores is cut into the foam layer for lighting and a wireless light is installed. One or more wireless switches are installed into a wall wherein the one or more switches are typically battery powered which reduces the installation costs associated with the installation of wiring. The wireless system is more energy efficient relative to typical installations.

Figure 39:
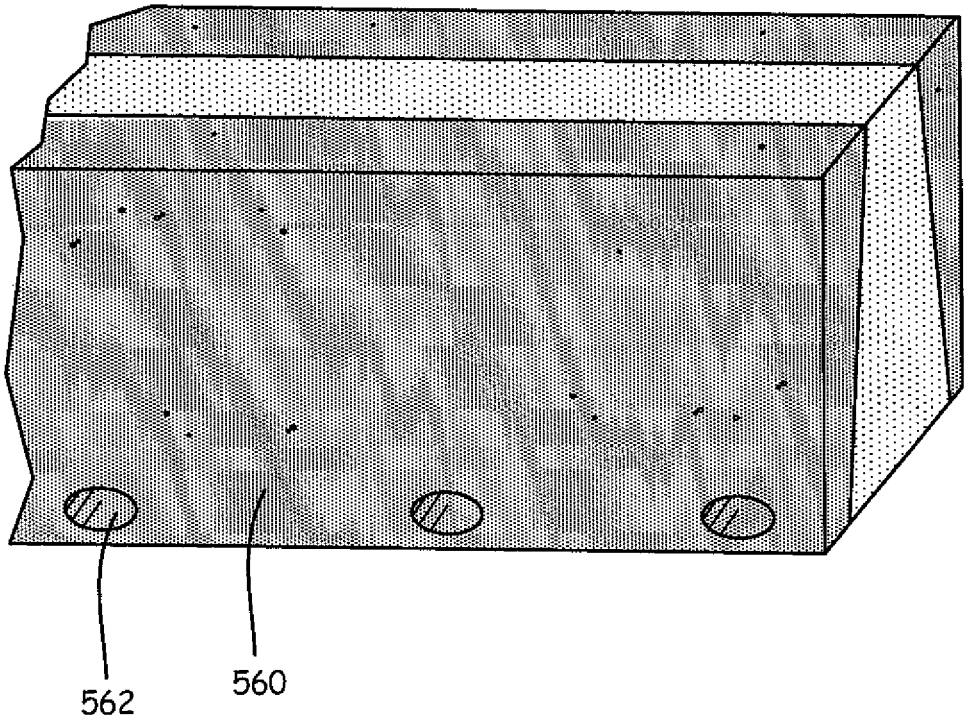
FIG. 39 is perspective view of another foundation with holes within the foam portion for drainage purposes.
Figure 40:
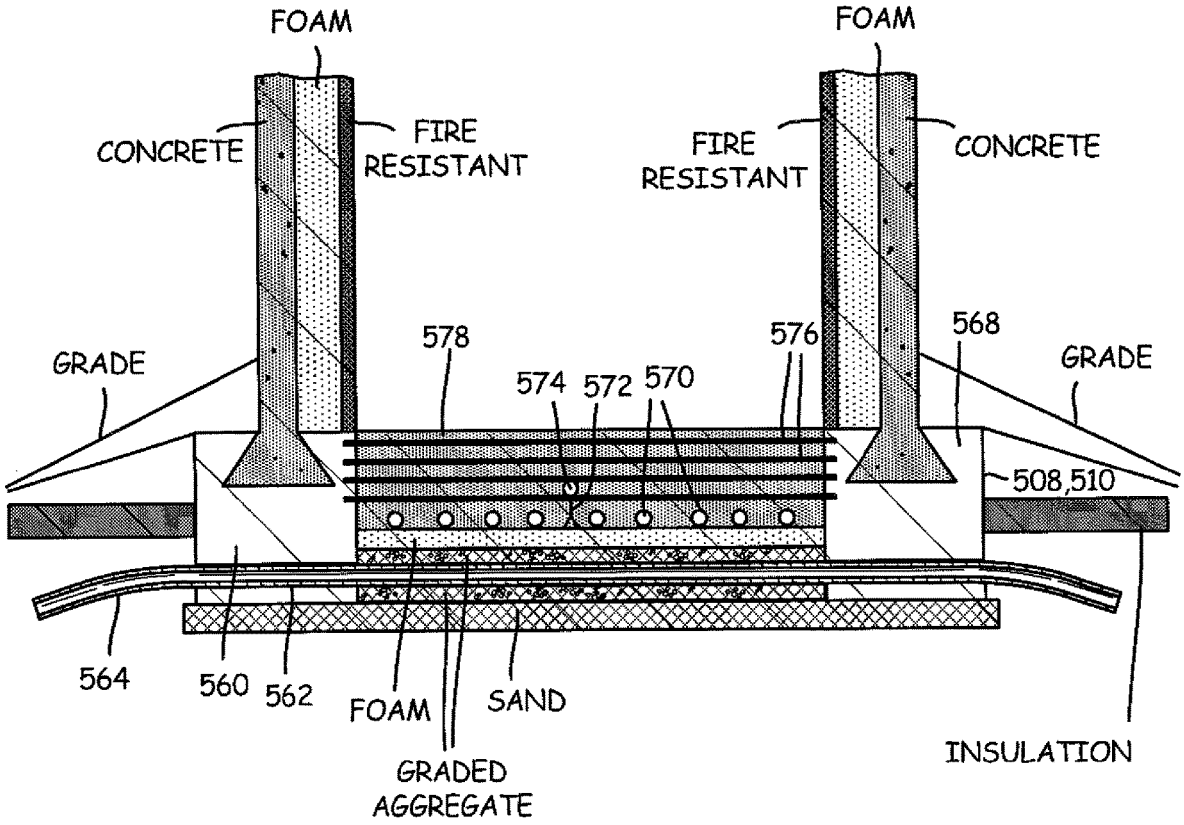
FIG. 40 is a schematic view of a foundation portion of a structure.

Referring to FIGS. 36 and 39, foam portions 560 of the foundations 508, 510 include through bores 562 that allow drainage tubing 564 to be installed in a pattern, typically a grid pattern. Referring to FIG. 40, a material 566 is placed over the drainage tubing wherein the material allows moisture and gases such as radon to travel therethrough and into the drainage tubing such that the moisture is removed from the structure. A typical material of construction is ¾ minus or 1 inch minus aggregate. The material is compacted to a required code and protects the drainage tubing or tile.

With the drainage tubes 564 installed, a layer of insulating foam 568 is positioned on the material 566 and radiant heat heating tubes 570 are installed and secured to the layer of foam 568. Rebar chairs 572 are installed on the foam layer 570 and at least one grid of rebar 574 is installed on the chairs 572. Rebar 574 is also positioned into the foam portions 560 of the foundations 508, 510 around the perimeter of the structure. Concrete 578 is then placed on the foam layer 568 and covers the radiant heating tubes 570 and the rebar 574, 576 wherein the rebar 576 extending into the foam portions 568 of the foundations 508, 510 ties the concrete slab 578 to the foundations 508, 510. A typical thickness of the concrete slab 578 is between four and ten inches and more typically between six and eight inches, however the thickness will be controlled by engineering specifications for the structure.

In some embodiments, a channel is cut into the inner surface of some walls. The channels provide a conduit to place electrical wiring into the structure. In some embodiments, the channels are cut proximate a bottom surface such that a floor board can be installed to cover the channel, which decreases construction costs. However, the channels for the wiring can be located anywhere within the inner surface of the walls.

In some instances, additional interior walls or hung cabinets are desired for a structure. To provide sufficient structural integrity for the interior walls or hung cabinetry, a channel can be cut into the inner surface of the foam of a size sufficient to secure a board therein with an adhesive. The board can then be utilized as a mounting material for the wall or the cabinetry. However, because the board does not extend to the concrete, there is no thermal bridge from the outdoor environment to the inside environment. Alternatively, the board can be anchored to the exterior concrete wythe.

A foam layer is installed about the perimeter of the foundations to protect the foundations from frost. Soil is then backfilled to a desired grade and covers the foam layer.

Figure 41:
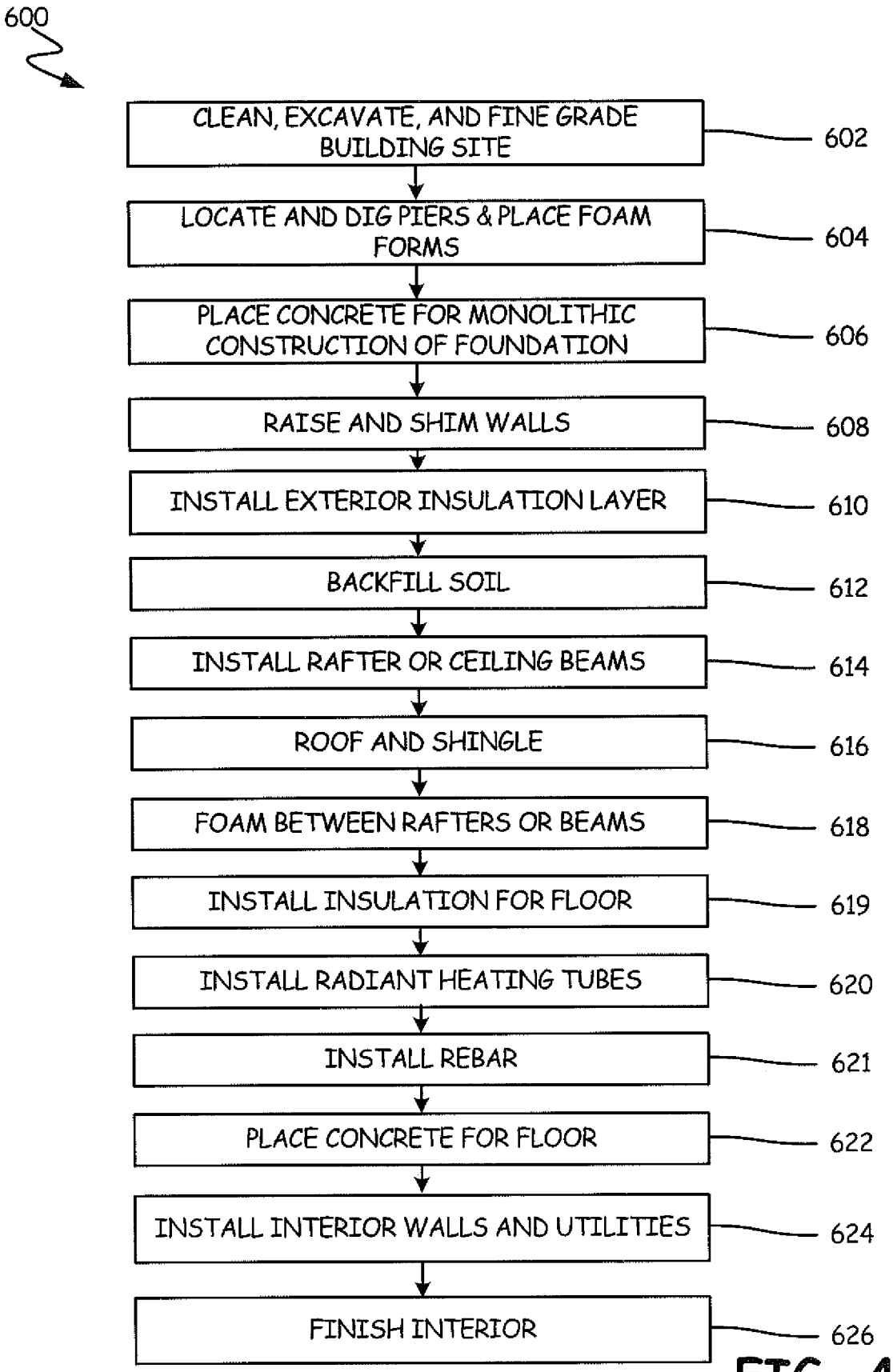
FIG. 41 is a flow chart of another exemplary building method.

Referring to FIG. 41, another building method is illustrated that is similar to that as disclosed with respect to FIG. 34. The method 600 includes cleaning, excavating and fine grading the building site at step 602. At step 604 piers are located and dug and foam forms are placed in position to define a perimeter of the structure. At step 606, concrete is placed in the foam forms and piers to create a monolithic foundation. Once the foundation is set, the method includes steps 608-626 that are similar or the same as disclosed with respect to steps 408-426 to complete the construction.

EXAMPLES

The present disclosure is more particularly described in the following examples that are intended as illustrations only, since numerous modifications and variations within the scope of the present disclosure will be apparent to those skilled in the art.

A simulation of the energy performance of the disclosed walls 12, 22, 200 and 380 along with a roof with the Gerard metal roof was conducted by DAREnergy Consulting located in Sacramento, Calif. using the CBECC-Res energy compliance software to determine the thermal efficiency of the disclosed structure. The fixed assumptions for the simulation included a structure 48 feet by 24 feet with an assumption that quality insulation installation (QII) was used to account for the lack of air gaps in the windows, doors and between the joints of the walls and because the disclosed structure has substantially no thermal bridging. An assumption was made that there were 4.4 changes of air per hour.

The construction of the walls was assumed to have a three inch wythe of concrete and variable thickness foam (EPS with an R value of 4.8/inch). The outer walls were covered with a layer of stucco and the inner layers were covered with gypsum board.

An assumption was made that the structure had 10% glass coverage with the long walls having 44.8 square feet of windows and the short walls having 22.4 square feet of windows. The windows were assumed to have a U-factor of 0.32 and a solar heat gain coefficient of 0.34.

The floor was a slab of concrete covered with tile. An insulating layer of R-10 insulation was installed outside of the structure a maximum distance of four feet.

As previously discussed the roof was a metal roof with cool roof properties for zones 12 and 14, and was assigned a 0.27 reflectance and 0.90 emittance. An R-5 above deck insulation was assumed and variable amounts of EPS foam was inserted between the rafter beams located on a 24" spacing. The roof assumed a 1 inch continuous layer of insulation and optionally a radiant barrier (such as foil) installed at the top of the attic to block solar gains from the roof.

The space conditioning assumed a combined hydronic and 90% boiler with no cooling. The wall thickness and insulating variables were simulated in different climate zones and include the following results for California Climate Zone 16 with and without a radiant barrier on the roof in Tables 1, California Climate Zone 14 with and without a radiant barrier on the roof, California Climate Zone 12 with and without a radiant barrier on the roof. Wall insulation thickness, and roof insulation was varied in the simulations. The results are as follows.

TABLE 1

| Cold (California Climate Zone 16) | | | | |
|---|---|---|---|---|
| Wall Insulation Variable | Roofing Variable | Roof Insulation Variable | Energy Design Rating | Performance |
| 8 inches (R38) | Gerard Metal Roof, no radiant barrier | 10 inches EPS (R48) | 88.39 | 56.6-58.8% |
| 6 inches (R31) | -same- | R48 + R5 | 89.47 | 55.1-57.5% |
| 5.5 inches (R26) | -same- | R48 + R5 | 90.58 | 53.6-56.1% |
| 4.5 inches (R22) | -same- | R48 + R5 | 91.80 | 51.9-54.5% |
| 3.5 inches (R17) | -same- | R48 + R5 | 94.04 | 48.9-51.7% |
| 2 inches (R10) | -same- | R48 + R5 | 100.21 | 40.5-43.9% |
| 8 inches (R38) | -same- | 8 inches EPS (R38) | 89.24 | 55.4-58.0% |
| 6 inches (R31) | -same- | R38 + R5 | 90.33 | 53.9-56.6% |
| 5.5 inches (R26) | -same- | R38 + R5 | 71.42 | 52.5-55.2% |
| 4.5 inches (R22) | -same- | R38 + R5 | 92.63 | 50.8-53.7% |
| 3.5 inches (R17) | -same- | R38 + R5 | 94.85 | 47.8-50.9% |
| 2 inches (R10) | -same- | R38 + R5 | 101.00 | 39.5-42.9% |
| 8 inches (R38) | -same- | 6 inches EPS (R29) | 90.40 | 53.8-56.8% |
| 6 inches (R31) | -same- | R29 + R5 | 91.47 | 52.4-55.5% |
| 5.5 inches (R26) | -same- | R29 + R5 | 92.57 | 50.9-54.1% |
| 4.5 inches (R22) | -same- | R29 + R5 | 93.75 | 49.3-52.5% |
| 3.5 inches (R17) | - same- | R29 + R5 | 95.94 | 46.3-49.6% |
| 2 inches (R10) | -same- | R29 + R5 | 102.07 | 38.0-41.5% |

TABLE 2

| High Desert (continued) | | | | |
|---|---|---|---|---|
| Wall Insulation Variable | Roofing Variable | Roof Insulation Variable | Energy Design Rating | Performance |
| 8 inches (R38) | Gerard Cool Roof w/ radiant barrier | 10 inched EPS (R48) | 97.79 | 43.6-49.2% |
| 6 inches (R31) | -same- | R48 + R5 | 98.68 | 42.3-48.1% |
| 5.5 inches (R26) | -same- | R48 + R5 | 99.70 | 40.9-46.9% |
| 4.5 inches (R22) | -same- | R48 + R5 | 100.83 | 39.3-45.3% |
| 3.5 inches (R17) | -same- | R48 + R5 | 102.94 | 36.4-42.6% |
| 2 inches (R10) | -same- | R48 + R5 | 108.93 | 28.2-35.2% |
| 8 inches (R38) | -same- | 8 inches EPS (R38) | 98.32 | 42.8-48.5% |
| 6 inches (R31) | -same- | R38 + R5 | 99.30 | 41.4-47.3% |
| 5.5 inches (R26) | -same- | R38 + R5 | 100.33 | 40.0-45.9% |
| 4.5 inches (R22) | -same- | R38 + R5 | 101.46 | 30.5-44.3% |
| 3.5 inches (R17) | -same- | R38 + R5 | 103.57 | 35.6-41.8% |
| 2 inches (R10) | -same- | R38 + R5 | 109.59 | 27.3-34.3% |
| 8 inches (R38) | -same- | 6 inches EPS (R29) | 99.17 | 41.6-47.3% |
| 6 inches (R31) | -same- | R29 + R5 | 100.16 | 40.2-46.0% |
| 5.5 inches (R26) | -same- | R29 + R5 | 101.19 | 38.8-44.6% |
| 4.5 inches (R22) | -same- | R29 + R5 | 102.33 | 37.3-43.3% |
| 3.5 inches (R17) | -same- | R29 + R5 | 104.44 | 34.4-40.7% |
| 2 inches (R10) | -same- | R29 + R5 | 110.47 | 26.1-33.1% |

TABLE 3

| High Desert (California Climate Zone 14) | | | | |
|---|---|---|---|---|
| Wall Insulation Variable | Roofing Variable | Roof Insulation Variable | Energy Design Rating | Performance |
| 8 inches (R38) | Gerard Cool Roof, no radiant barrier | 10 inches EPS (R48) | 98.36 | 42.7-48.6% |
| 6 inches (R31) | -same- | R48 + R5 | 99.26 | 41.5-47.4% |
| 5.5 inches (R26) | -same- | R48 + R5 | 100.29 | 40.1-45.9% |
| 4.5 inches (R22) | -same- | R48 + R5 | 101.40 | 38.5-44.6% |
| 3.5 inches (R17) | -same- | R48 + R5 | 103.53 | 35.6-41.9% |
| 2 inches (R10) | -same- | R48 + R5 | 109.54 | 27.4-34.4% |
| 8 inches (R38) | -same- | 8 inches EPS (R38) | 98.99 | 41.8-47.6% |
| 6 inches (R31) | -same- | R38 + R5 | 99.98 | 40.5-46.3% |
| 5.5 inches (R26) | -same- | R38 + R5 | 101.00 | 39.1-45.1% |
| 4.5 inches (R22) | -same- | R38 + R5 | 102.14 | 37.5-43.4% |
| 3.5 inches (R17) | -same- | R38 + R5 | 104.26 | 34.6-41.0% |

TABLE 3-continued

| High Desert (California Climate Zone 14) | | | | |
|---|---|---|---|---|
| Wall Insulation Variable | Roofing Variable | Roof Insulation Variable | Energy Design Rating | Performance |
| 2 inches (R10) | -same- | R38 + R5 | 110.27 | 26.4-33.4% |
| 8 inches (R38) | -same- | 6 inches EPS (R29) | 99.96 | 40.5-46.1% |
| 6 inches (R31) | -same- | R29 + R5 | 100.96 | 39.1-45.0% |
| 5.5 inches (R26) | -same- | R29 + R5 | 101.99 | 37.7-43.5% |
| 4.5 inches (R22) | -same- | R29 + R5 | 103.13 | 36.2-42.2% |
| 3.5 inches (R17) | -same- | R29 + R5 | 105.25 | 33.3-39.6% |
| 2 inches (R10) | -same- | R29 + R5 | 111.27 | 25.0-32.0% |

TABLE 4

| Hot & Cold (California Climate Zone 12) | | | | |
|---|---|---|---|---|
| Wall Insulation Variable | Roofing Variable | Roof Insulation Variable | Energy Design Rating | Performance |
| 8 inches (R38) | Gerard Cool Roof, no radiant barrier | 10 inches EPS (R48) | 89.77 | 42.9-49.4% |
| 6 inches (R31) | -same- | R48 + R5 | 90.51 | 41.5-48.2% |
| 5.5 inches (R26) | -same- | R48 + R5 | 91.31 | 40.0-46.9% |
| 4.5 inches (R22) | -same- | R48 + R5 | 92.12 | 38.5-45.5% |
| 3.5 inches (R17) | -same- | R48 + R5 | 93.68 | 35.6-42.9% |
| 2 inches (R10) | -same- | R48 + R5 | 98.22 | 27.2-35.2% |
| 8 inches (R38) | -same- | 8 inches EPS (R38) | 90.40 | 41.7-48.3% |
| 6 inches (R31) | -same- | R38 + R5 | 91.11 | 40.4-47.0% |
| 5.5 inches (R26) | -same- | R38 + R5 | 91.89 | 38.9-45.8% |
| 4.5 inches (R22) | -same- | R38 + R5 | 92.71 | 37.4-44.4% |
| 3.5 inches (R17) | -same- | R38 + R5 | 94.32 | 34.4-41.7% |
| 2 inches (R10) | -same- | R38 + R5 | 98.84 | 26.0-34.0% |
| 8 inches (R38) | -same- | 6 inches EPS (R29) | 91.19 | 40.2-46.8% |
| 6 inches (R31) | -same- | R29 + R5 | 91.96 | 38.8-45.5% |
| 5.5 inches (R26) | -same- | R29 + R5 | 92.69 | 37.4-44.3% |
| 4.5 inches (R22) | -same- | R29 + R5 | 93.54 | 35.9-42.9% |
| 3.5 inches (R17) | -same- | R29 + R5 | 95.15 | 32.9-40.1% |
| 2 inches (R10) | -same- | R29 + R5 | 99.69 | 24.5-32.4% |

TABLE 5

| Hot & Cold (continued) | | | | |
|---|---|---|---|---|
| Wall Insulation Variable | Roofing Variable | Roof Insulation Variable | Energy Design Rating | Performance |
| 8 inches (R38) | Gerard Cool Roof, w/radiant barrier | 10 inches EPS (R48) | 89.28 | 43.8-50.2% |
| 6 inches (R31) | -same- | R48 + R5 | 90.03 | 42.4-49.0% |
| 5.5 inches (R26) | -same- | R48 + R5 | 90.82 | 40.9-47.7% |
| 4.5 inches (R22) | -same- | R48 + R5 | 91.63 | 39.4-46.3% |
| 3.5 inches (R17) | -same- | R48 + R5 | 93.19 | 36.5-43.7% |
| 2 inches (R10) | -same- | R48 + R5 | 97.73 | 28.1-36.0% |
| 8 inches (R38) | -same- | 8 inches EPS (R38) | 89.81 | 42.8-49.2% |
| 6 inches (R31) | -same- | R38 + R5 | 90.57 | 41.4-48.0% |
| 5.5 inches (R26) | -same- | R38 + R5 | 91.33 | 40.0-46.7% |
| 4.5 inches (R22) | -same- | R38 + R5 | 92.20 | 38.3-45.3% |
| 3.5 inches (R17) | -same- | R38 + R5 | 93.73 | 35.5-42.7% |
| 2 inches (R10) | -same- | R38 + R5 | 98.27 | 27.1-35.0% |
| 8 inches (R38) | -same- | 6 inches EPS (R29) | 90.53 | 41.4-47.8% |
| 6 inches (R31) | -same- | R29 + R5 | 91.31 | 40.0-46.6% |
| 5.5 inches (R26) | -same- | R29 + R5 | 92.05 | 38.6-45.4% |
| 4.5 inches (R22) | -same- | R29 + R5 | 92.89 | 25.7-33.6% |
| 3.5 inches (R17) | -same- | R29 + R5 | 94.48 | 34.1-41.3% |
| 2 inches (R10) | -same- | R29 + R5 | 99.02 | 37.1-44.0% |

The Energy Design Rating reflects the annual energy consumption including lighting, domestic appliances, and electronics not included in the California Title 24 performance. The Performance is a percentage of the level above a building that complies with California's Energy Efficiency Standards (Title 24, Part 6) for space conditioning and water heating. The lower range of performance is an East/West front orientation of the building and the higher range is for a North/South front orientation of the building.

The results of the simulation indicate a significant increase in energy efficiency relative to California Energy Efficiency Standards. The simulations surprisingly indicated at least a forty percent increase in performance independent of the climate zone and whether or not a radiant barrier was considered. Also, comparing the simulations with the radiant barrier to simulations without the radiant barrier resulted in a slight increase in simulated energy efficiency.

Although the subject matter has been described in language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

The invention claimed is:

1. A method of building a structure with an interior space, the method comprising:

forming a plurality of spaced apart holes in soil for piers;

positioning a foam structure having a length, a width and a height between adjacent holes of the plurality of holes and about a perimeter of the building, wherein the foam structure includes a channel, wherein the channel is in communication with the plurality of spaced apart holes;

placing concrete in the channel such that the channels and the plurality of spaced apart holes are filled to form a unitary structure of concrete having piers within the plurality of holes that are connected to a concrete member within the channel, wherein the unitary structure of concrete and the foam structure form a foundation partially below grade;

providing a plurality of panels, each panel comprising:

a foam layer; and a concrete layer secured to the foam layer;

tilting each of the panels to a vertical position such that each of the plurality of panels is supported by the concrete portion of the foundation and the concrete layer provides an exterior surface;

securing each of the plurality of panels to the foundation;

securing adjacent panels of the plurality of panels to each other; and sealing seams between adjacent panels.

2. The method of claim 1 and further comprising:

securing a plurality of beams to an upper portion of the plurality of panels in the vertical position.

3. The method of claim 2, wherein securing the plurality of beams to an upper portion of the raised plurality of panels comprises:

placing ends of the beams within U shaped channels extending into the foam layer from a top edge.

4. The method of claim 2 and further comprising:

positioning insulation between adjacent beams of the plurality of beams.

5. The method of claim 2, wherein the plurality of beams comprise rafter beams.

6. The method of claim 5, and further comprising:

securing a roof to the rafter beams.

7. The method of claim 1, and further comprising:

positioning a width of insulation adjacent the foundation and extending from the foundation below grade; and backfilling soil from the width of insulation to the exterior surface of the wall.

8. The method of claim 1, and further comprising:

positioning a foam layer adjacent the foundation; and installing a radiant heating system on the foam layer adjacent the foundation.

9. The method of claim 8, and further comprising:

placing concrete over the radiant heating system to form a floor.

10. The method of claim 1, and further comprising:

installing a drainage system below grade prior to positioning the foundation.

11. A method of building a structure with an interior space, the method comprising:

forming a plurality of spaced apart holes in soil for piers;

positioning a foam structure having a length, a width and a height between adjacent holes of the plurality of holes and about a perimeter of the structure, wherein the foam structure includes a channel, wherein the channel is in communication with the plurality of spaced apart holes;

placing concrete in the channel such that the channels and the plurality of spaced apart holes are filled to form a unitary structure of concrete having piers within the holes connected to a concrete member within the channel, wherein the unitary structure of concrete and the foam structure form a foundation partially below grade;

providing a plurality of panels, each panel comprising:

a foam layer; and a concrete layer secured to the foam layer;

tilting each of the panels to a vertical position such that each of the plurality of panels is supported by the concrete portion of the foundation and the concrete layer provides an exterior surface;

securing each of the plurality of panels to the foundation;

securing adjacent panels of the plurality of panels to each other;

sealing seams between adjacent panels;

placing ends of a plurality of beams on a top surface of the plurality of panels;

positioning insulation between adjacent beams of the plurality of beams; and securing a roof to the plurality of beams.

12. The method of claim 11, and further comprising:

positioning a width of insulation adjacent the foundation and extending from the foundation below grade; and backfilling soil over the width of insulation to the exterior surface of the wall.

13. The method of claim 11, and further comprising:

positioning a foam layer adjacent the foundation; and installing a radiant heating system on the foam layer adjacent the foundation.

14. The method of claim 13, and further comprising:

placing concrete over the radiant heating system to form a floor.

15. The method of claim 11, and further comprising:

installing a drainage system below grade prior to positioning the foundation.

* * * * *